US007767030B2

(12) United States Patent
Addicks et al.

(10) Patent No.: US 7,767,030 B2
(45) Date of Patent: Aug. 3, 2010

(54) CLEANING DEVICE

(75) Inventors: Joseph Addicks, Baltimore, MD (US); Dmitriy A. Kozerovskiy, Baltimore, MD (US); Kevin Barnes, Westminster, MD (US); Gary W. Albrent, Arnold, MD (US)

(73) Assignee: Chemical Specialties Manufacturing Corp., Baltimore, MD (US)

( * ) Notice: Subject to any disclaimer, the term of this patent is extended or adjusted under 35 U.S.C. 154(b) by 0 days.

(21) Appl. No.: 12/236,977

(22) Filed: Sep. 24, 2008

(65) Prior Publication Data

US 2009/0078290 A1 Mar. 26, 2009

Related U.S. Application Data

(60) Provisional application No. 60/974,588, filed on Sep. 24, 2007.

(51) Int. Cl.

| | |
|---|---|
| ***B08B 3/04*** | (2006.01) |
| ***B08B 5/04*** | (2006.01) |
| ***A47L 11/10*** | (2006.01) |
| ***A47L 11/30*** | (2006.01) |

(52) U.S. Cl. ..... 134/58 R; 134/21; 15/320

(58) Field of Classification Search ..... 15/320; 134/21, 58 R

See application file for complete search history.

(56) References Cited

U.S. PATENT DOCUMENTS

| | | | | |
|---|---|---|---|---|
| 1,480,662 | A | 1/1924 | Caine | |
| 2,893,037 | A | 7/1959 | Strong | |
| 3,686,707 | A | 8/1972 | Hughes et al. | |
| 3,797,065 | A | 3/1974 | Hughes | |
| 4,642,842 | A | 2/1987 | Hughes et al. | |
| 5,522,114 | A | 6/1996 | Allison | |
| 6,368,373 | B1 * | 4/2002 | Mueller | 55/443 |
| 2004/0108266 | A1 * | 6/2004 | Agnew | 210/532.1 |
| 2006/0117517 | A1 * | 6/2006 | Michael et al. | 15/320 |
| 2007/0186957 | A1 * | 8/2007 | Field et al. | 134/18 |

FOREIGN PATENT DOCUMENTS

| | | |
|---|---|---|
| FR | 1074335 | 10/1954 |
| GB | 834149 | 5/1960 |
| JP | 07116099 | 5/1995 |
| WO | 01/58333 | 8/2001 |

* cited by examiner

OTHER PUBLICATIONS

International Search Report and Written Opinion from PCT/US08/77498, mailed Nov. 27, 2008.

*Primary Examiner*—Michael Komakov
*Assistant Examiner*—Natasha Campbell
(74) *Attorney, Agent, or Firm*—Calfee, Halter & Griswold LLP

(57) ABSTRACT

The present application relates to a method and device for cleaning surfaces. In one embodiment, a cleaning device includes a cleaning tool, a motor, a reservoir, an extractor, and a recovery tank. The reservoir stores fluid and may act as a base of the cleaning device. The extractor suctions used fluid from the surface and may be removably attached to the reservoir such that the extractor may be raised and lowered relative to the surface. The recovery tank stores the used fluid from the extractor and may be located adjacent the reservoir. The reservoir may also be formed to fit at least partially around the motor. The cleaning device may also be designed such that at least a portion of the weight of the fluid in the reservoir and the used fluid in the recovery tank is over the cleaning tool.

27 Claims, 44 Drawing Sheets

CLEANING DEVICE

CROSS REFERENCE TO RELATED APPLICATIONS

The present application claims priority to, and any other benefit of, U.S. Provisional Patent Application Ser. No. 60/974,588, filed Sep. 24, 2007, and entitled Cleaning Device, the entire contents of which are hereby incorporated by reference.

FIELD OF INVENTION

The present application relates to a method and device for cleaning surfaces, such as carpets and floors. More particularly, the application relates to a device configured to dispense cleaning fluid on a surface, clean the surface, and recover the used fluid from the surface.

BACKGROUND

Cleaning devices for cleaning surfaces, such as carpets and floors, are known. Conventional devices, such as rotary scrubbers, are cumbersome to use and difficult to control due to the weight and distribution of the device components. For example, conventional devices generally have a solution tank mounted to the handle of the device, which results in operator fatigue. Further, these devices are generally too high to clean under objects such as most chairs, tables, desks, sinks, and bathroom stalls. Conventional devices also do not permit cleaning in any direction at least due to the configuration of the fluid recovery system.

SUMMARY OF INVENTION

The present application relates to a method and device for cleaning surfaces, such as carpets and floors. In one embodiment, a cleaning device includes a cleaning tool, a motor, a reservoir, an extractor, and a recovery tank. The motor activates the cleaning tool. The reservoir stores fluid and may act as a base of the cleaning device. The extractor suctions used fluid from the surface and may be removably attached to at least one lift rod which may be movably attached to the reservoir. As such, the extractor may be raised and lowered relative to the surface. The recovery tank stores the used fluid from the extractor and may be located adjacent the reservoir. The reservoir may also be formed to fit at least partially around the motor. The cleaning device may also be designed such that at least a portion of the weight of the fluid in the reservoir and the used fluid in the recovery tank is over the cleaning tool. The overall height of the cleaning device may be equal to or less than 24 inches.

In another embodiment, a method of cleaning a surface using a cleaning device is disclosed. Fluid may be stored in a reservoir that acts as a base of the cleaning device. The fluid may be dispensed onto at least one of the surface and a cleaning tool of the cleaning device. The surface may be cleaned using the cleaning tool. The used fluid may be suctioned from the surface and into a removable recovery tank using an extractor that is removably attached to at least one lift rod. The at least one lift rod may be movably attached to the reservoir such that the extractor may be raised and lowered relative to the surface. The used fluid may be emptied from the removable recovery tank. The recovery tank may be at least partially supported by the reservoir and formed to fit at least partially around a motor of the cleaning device.

Additional and/or alternative advantages, objects, and/or salient features of the invention will become apparent from the following detailed description, which, taken in conjunction with the annexed drawings and claims, disclose preferred embodiments of the invention. It is to be understood that both the foregoing general description and the following detailed description are exemplary and explanatory only and are not restrictive of the invention, as claimed. The embodiments described in the specification do not limit the scope of the claims in any way and the terms used in the claims have all of their full ordinary meanings.

BRIEF DESCRIPTION OF THE DRAWINGS

The invention may be more readily understood by reference to the following drawings wherein.

DETAILED DESCRIPTION

Figure 1:
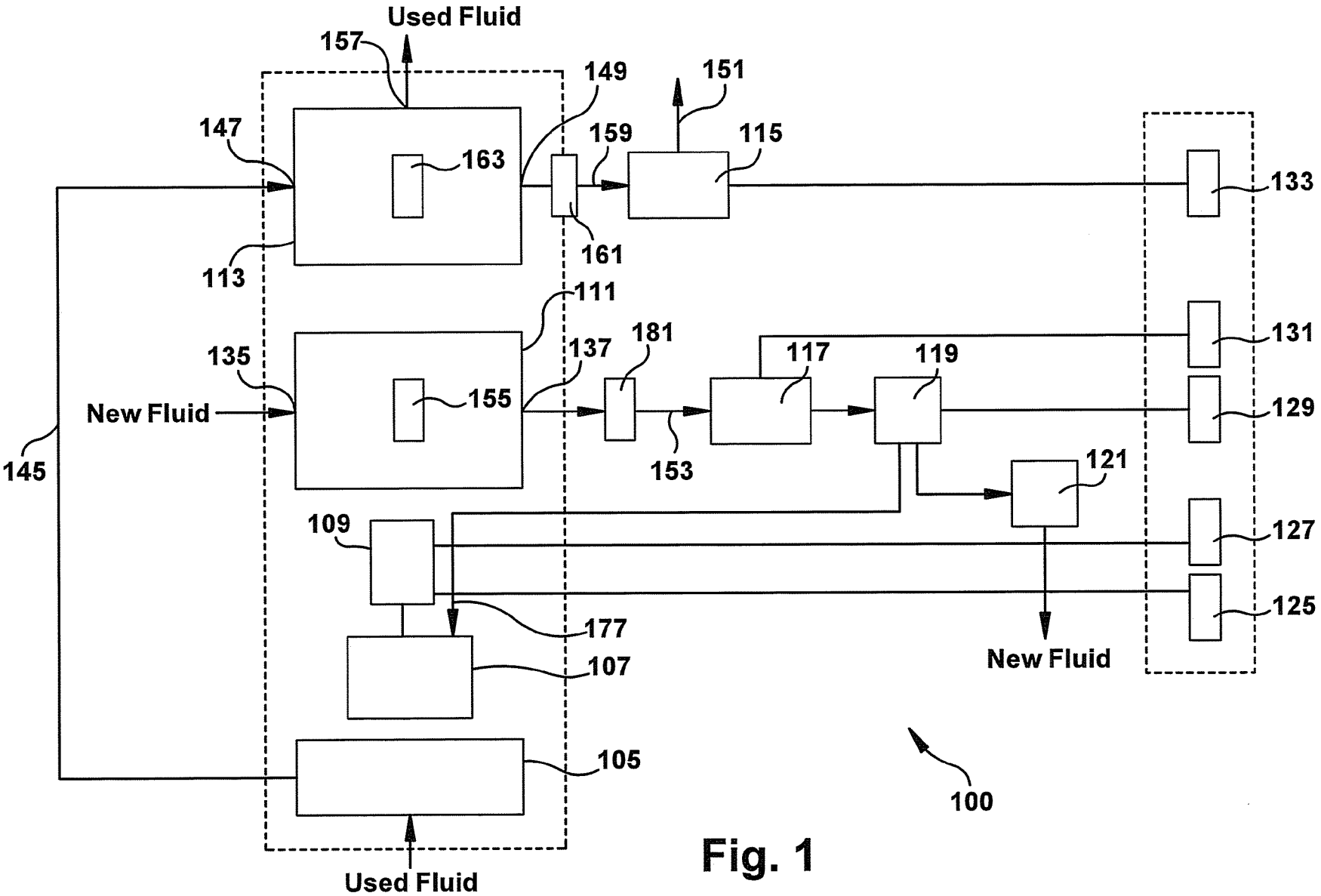
FIG. 1 is a schematic view of a cleaning device according to an embodiment of the present invention.

The invention will now be described with occasional reference to specific embodiments of the invention. This invention may, however, be embodied in different forms and should not be construed as limited to the embodiments set forth herein. Rather, these embodiments are provided so that this disclosure will fully convey the scope of the invention to those skilled in the art.

Except as otherwise specifically defined herein, all terms used herein have the same meaning as commonly understood by one of ordinary skill in the art to which this invention belongs. The terminology used in the description of the invention herein is for describing particular embodiments only, and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities, properties, and so forth as used in the specification and claims are to be understood as being modified in all instances by the term "about." Accordingly, unless otherwise indicated, the numerical properties set forth in the following specification and claims are approximations that may vary depending on the desired properties sought to be obtained in embodiments of the present invention. Notwithstanding that the numerical ranges and parameters setting forth the broad scope of the invention are approximations, the numerical values to the extent that such are set forth in the specific examples are reported as precisely as possible. Any numerical values, however, inherently contain certain errors necessarily resulting from error found in their respective measurements.

It should be noted, however, that for the purposes of this application, the terms attach (attached), connect (connected), and mount (mounted) are not limited to direct attachment, connection, or mounting, but also include indirect attachment, connection, or mounting with intermediate parts, components, or assemblies being located between the two parts being attached, connected, or mounted to one another. In addition, the terms attach (attached), connect (connected), and mount (mounted) may include two parts integrally formed or unitarily constructed.

The present application discloses a cleaning device suitable for cleaning carpets and floors. Those skilled in the art will readily appreciate that the device may be used and configured for a variety of uses. For example, in certain embodiments, various types of cleaning tools and extractors may be used to clean several types of surfaces, such as for example tile, glass, or wood. The device is sized and configured (for example, the overall unit height may be less than 24" high) to clean under objects such as chairs, tables, desks, sinks, and bathroom stalls. The device is also configured such that most of the weight of the device and the water and cleaning fluid the device may contain is centered over the cleaning tool. With the majority of the weight over the cleaning tool, the device is easier to control and provides for a continual cleaning tool pressure throughout the cleaning cycle. Further, the device is more ergonomic and operator fatigue is reduced. In some embodiments, the configuration of the extractor ring allows the operator to clean in any direction.

Referring now to the drawings, FIG. 1 is a schematic view of a cleaning device 100. The cleaning device 100 includes a reservoir 111, a recovery tank 113, an extractor 105, a cleaning tool 107, and a motor 109. The cleaning device 100 also has a dispensing system, including a pump 117 and a valve assembly 119, to dispense new cleaning fluid from the reservoir 111 onto a cleaning surface and/or the cleaning tool 107. The cleaning tool 107, generally activated by the motor 109, utilizes the cleaning fluid as it scrubs the cleaning surface. The cleaning device 100 may also have a vacuum system, including a vacuum motor 115, that allows the extractor 105 to suction the used cleaning fluid from the cleaning surface and into the recovery tank 113, which may be emptied by the user. The cleaning device 100 may also have a handle and wheels to help the user guide the device and a cover to protect the mechanical and electrical components.

For example, FIGS. 2A-2G generally show a cleaning device 200 according to an embodiment of the invention. As shown in FIGS. 2A-2G, the cleaning device 200 includes a reservoir tank 212, a recovery tank 214, an extractor ring 222, a cleaning brush 224, and a motor 510 (shown in FIG. 5A). As shown in FIG. 6B, the cleaning device 200 also has a dispensing system, including a pump 620 and valve assembly 622, 624, to dispense new cleaning fluid from the reservoir 212 onto a cleaning surface and/or the cleaning brush 224. The cleaning device 200 also has a vacuum system, including a vacuum motor 626, which allows the extractor ring 222 to suction the used cleaning fluid from the cleaning surface and into the recovery tank 214. As shown in FIGS. 2A-2G, the cleaning device 200 has a handle 218 and wheels 220 to help the user guide the device and an equipment shroud 216 to protect the mechanical and electrical components. As shown, the cleaning device 200 weighs approximately 130 lbs. empty and the overall height (not including the handle) is approximately less than 24 inches.

The reservoir of the cleaning device is generally a hollow container, or tank, that stores the new cleaning fluid to be applied to a cleaning surface. The reservoir may be various shapes and sizes. The reservoir may be made of plastic; however, other suitable materials may be used, such as stainless steel. The reservoir may be rotationally molded. Rotational molding is a production process used to create a strong, hollow product. Of course, the reservoir may be produced by other methods known in the art, such as injection molding. The reservoir may also be translucent to allow for easy visualization of the fluid level in the reservoir.

Figure 2A:
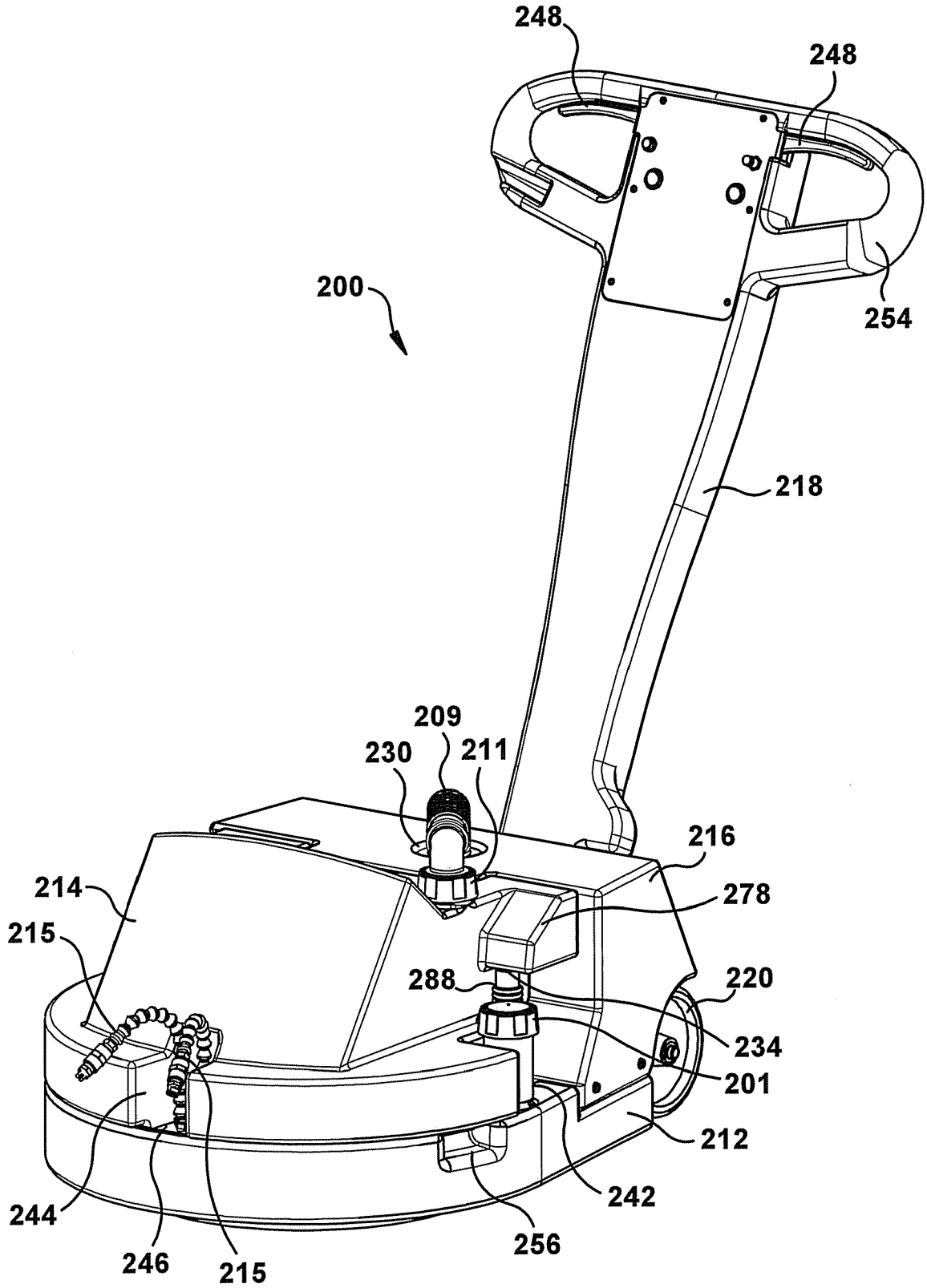
FIGS. 2A-2G are perspective, front, left side, rear, right side, top, and bottom views, respectively, of an assembled cleaning device according to another embodiment of the invention.
Figure 2B:
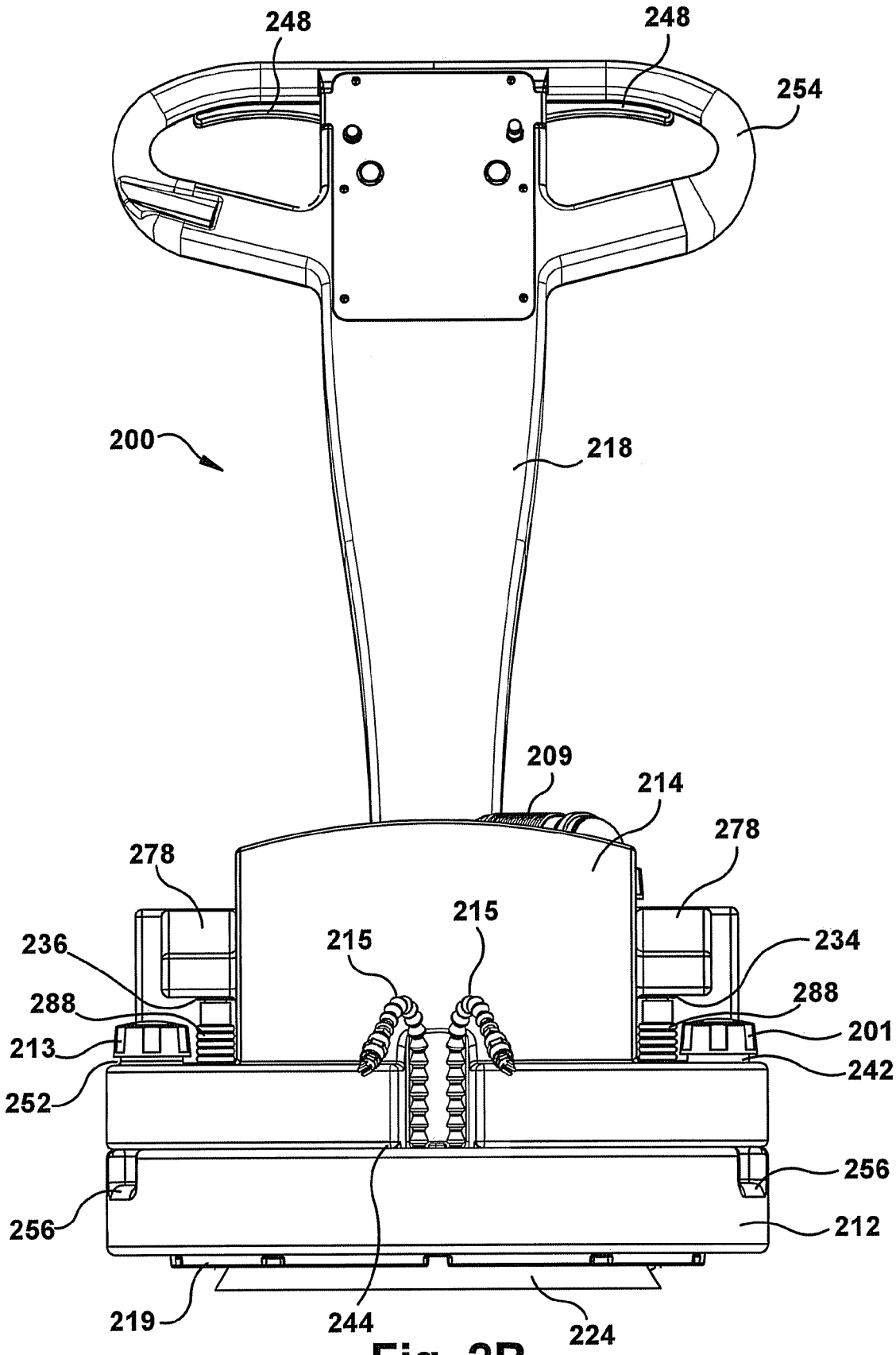
Figure 2C:
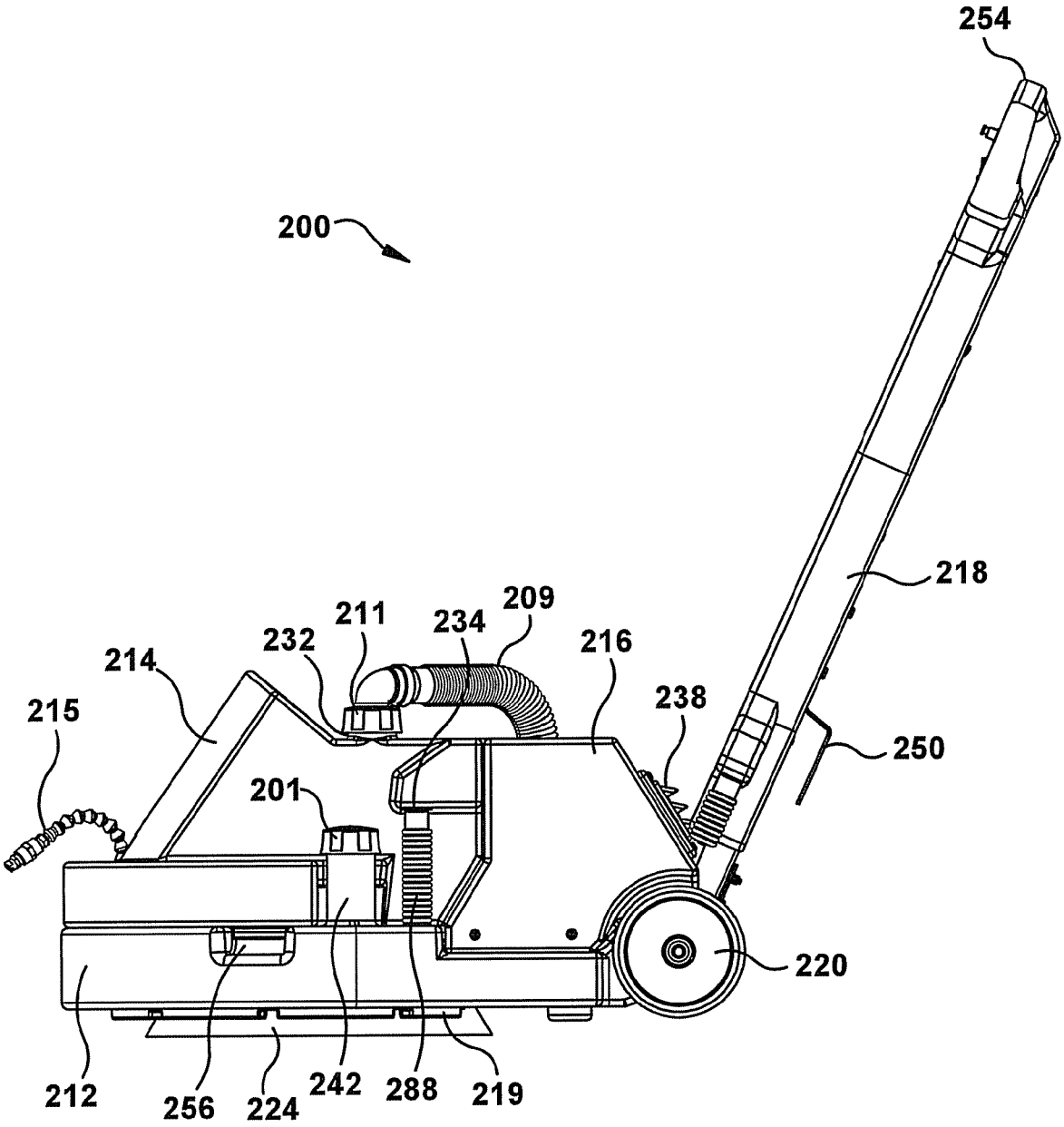
Figure 2D:
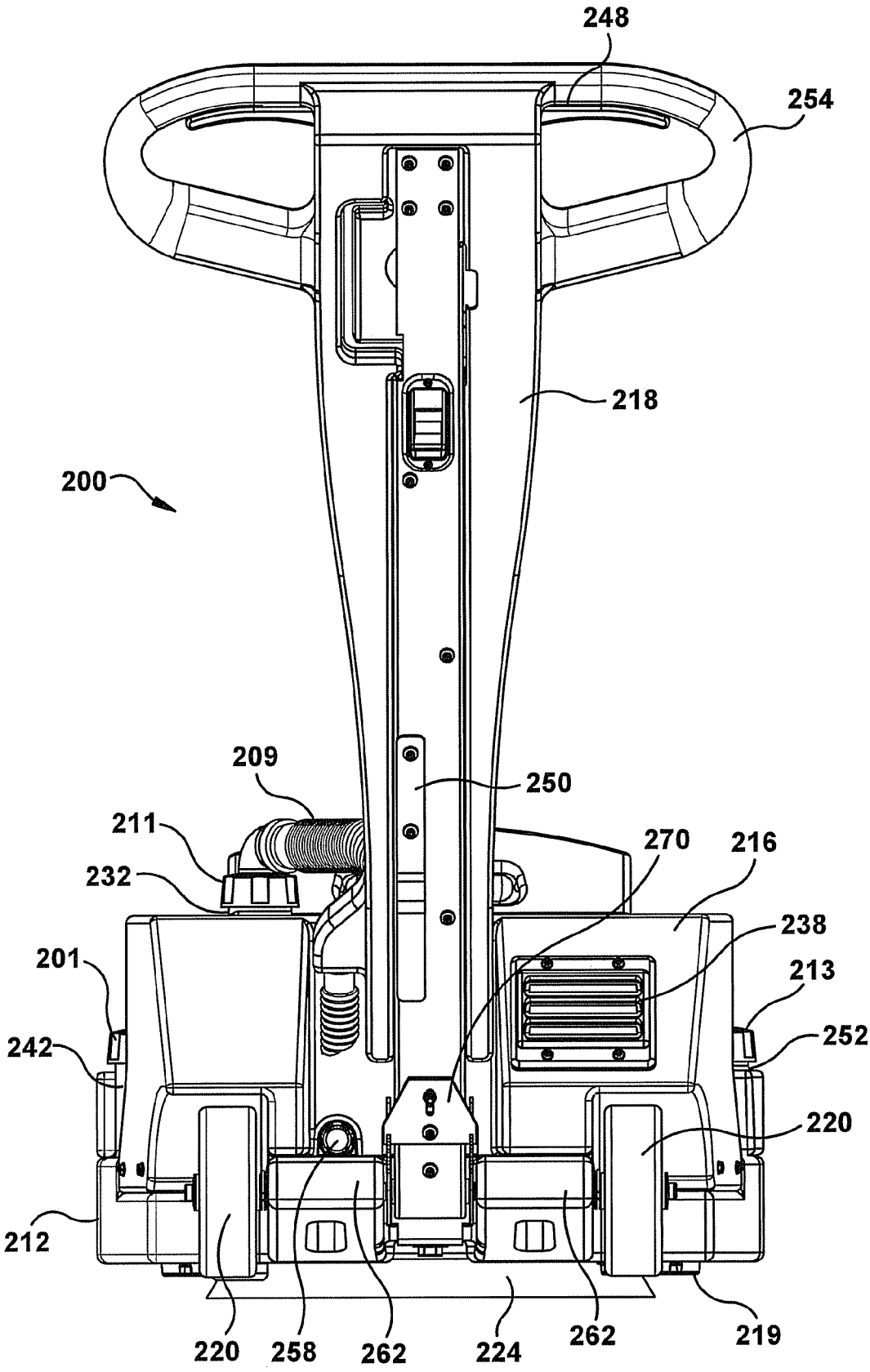
Figure 2E:
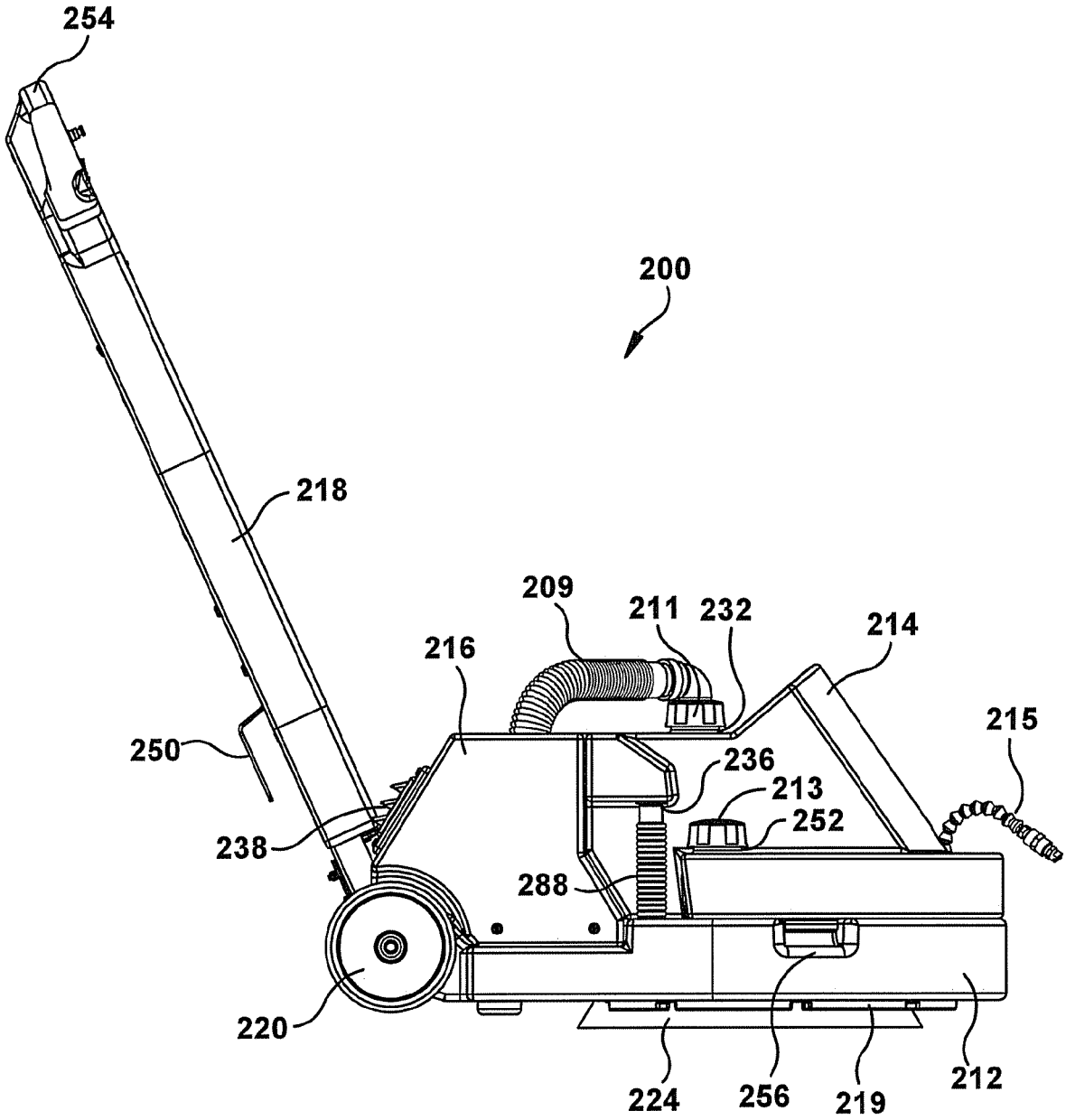
Figure 2F:
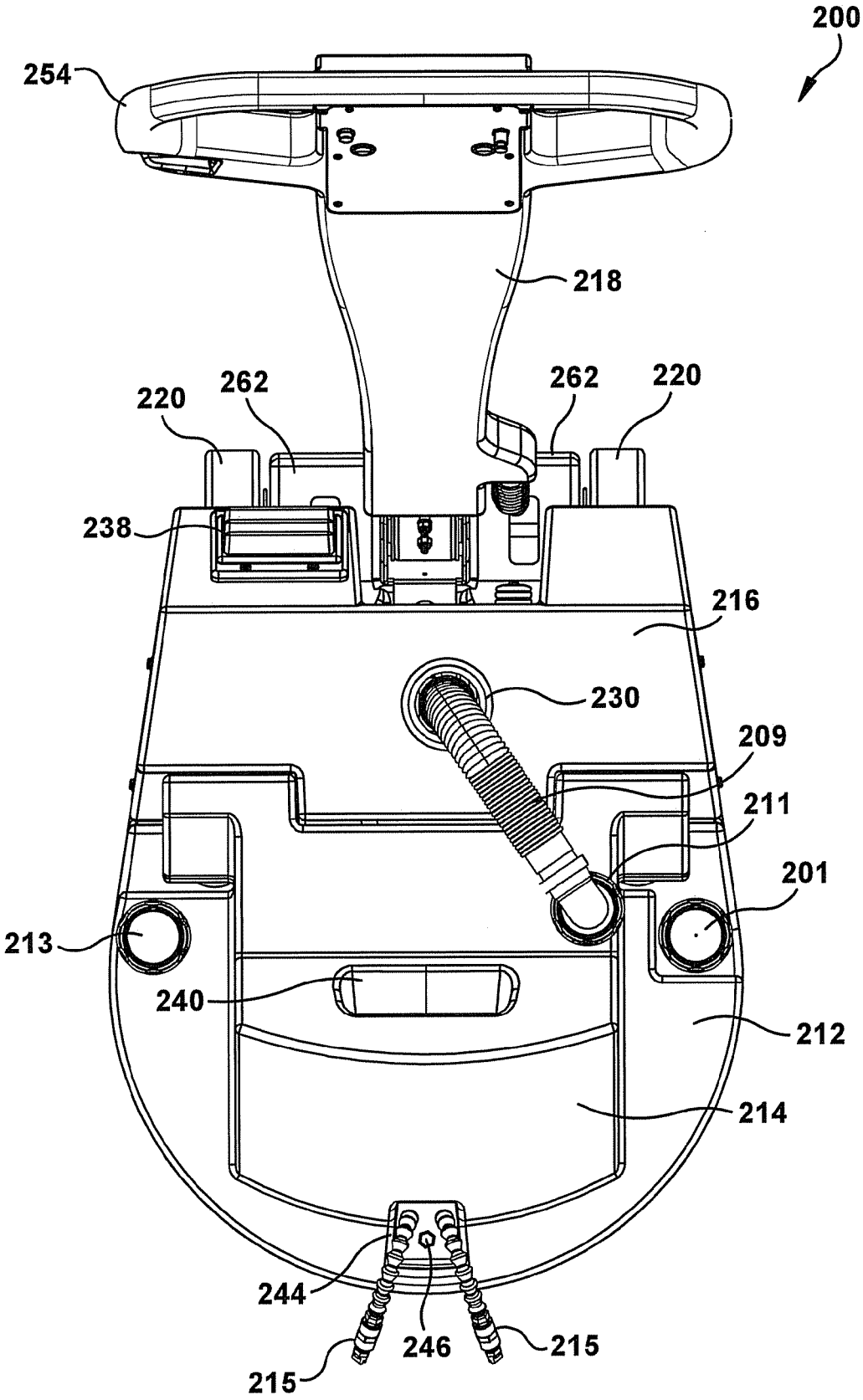
Figure 2G:
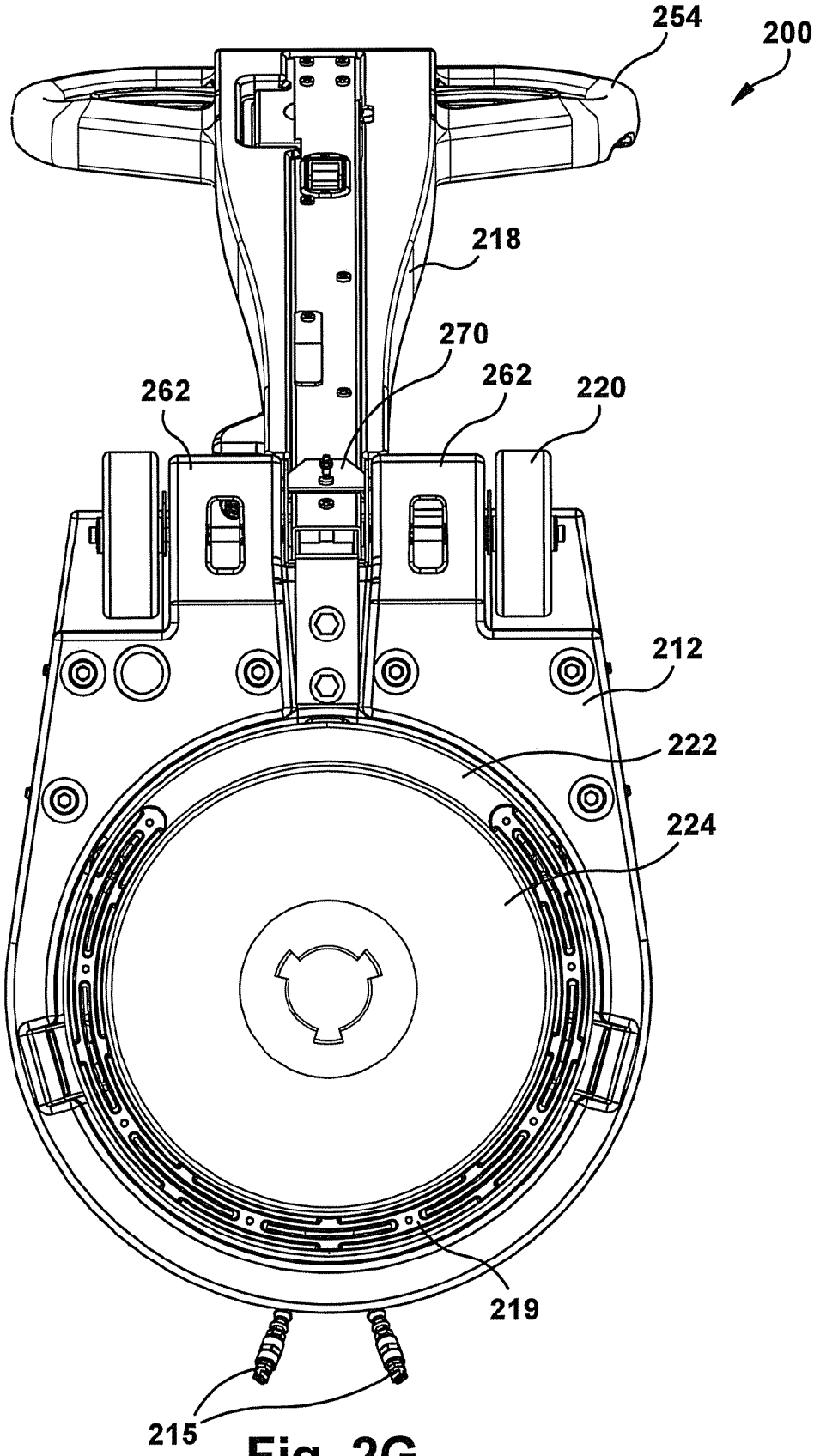
Figure 3A:
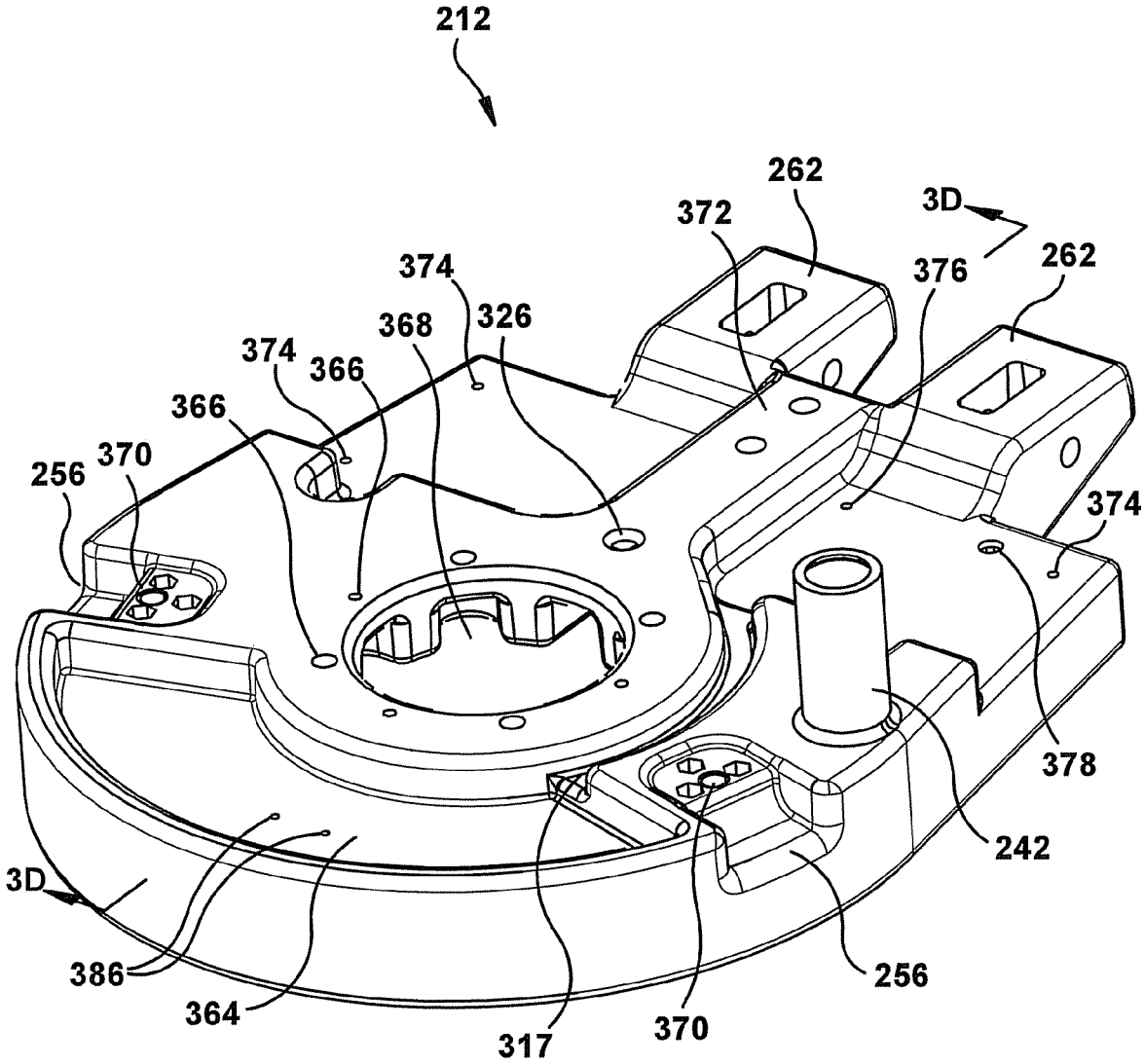
FIGS. 3A-3C are perspective, top, and bottom views, respectively, of a reservoir tank of the cleaning device shown in FIGS. 2A-2G.
Figure 3B:
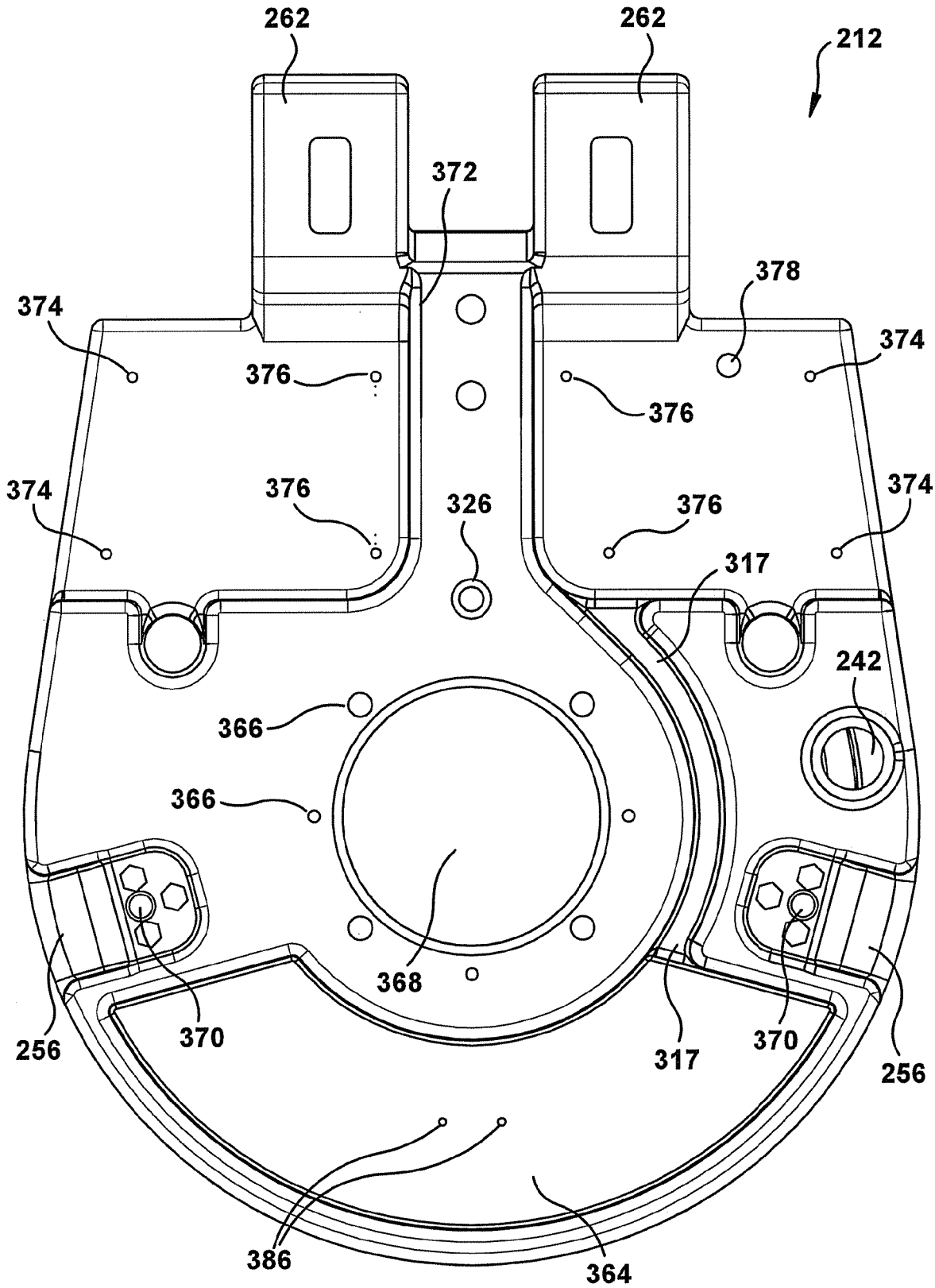
Figure 3C:
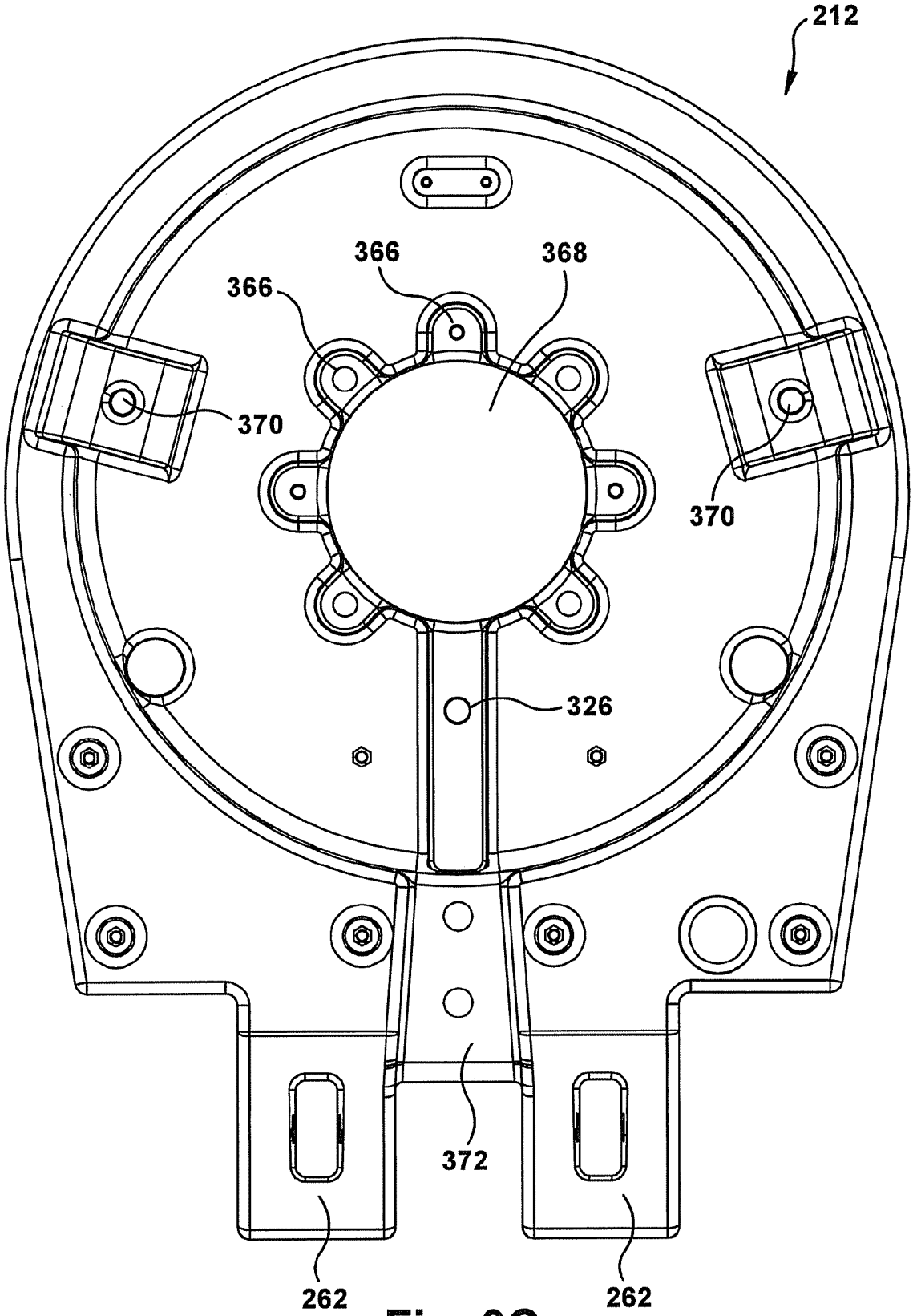
Figure 3D:
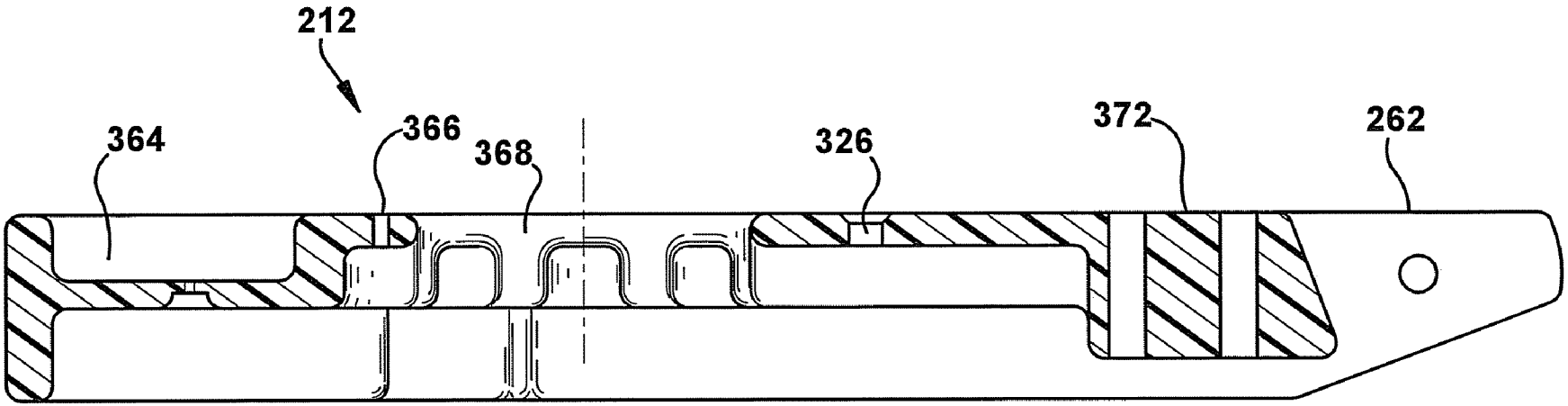
FIG. 3D is a cross sectional view of the reservoir tank shown in FIGS. 3A-3C.

FIGS. 3A-3D generally depict the reservoir tank 212 of the cleaning device 200. The depicted reservoir tank 212 is made of plastic and is rotationally molded. As shown in FIG. 2A-2G, the reservoir tank 212 also acts as a base for the cleaning device 200. As such, the tank 212 and cleaning fluid have a low center of gravity. In addition, the weight of the tank 212 and cleaning fluid is distributed over the brush 224 (shown in FIG. 2G). The distribution of the weight and low center of gravity allow the cleaning device 200 to be more balanced and easier to control. As shown, the capacity of the reservoir tank 212 is approximately 3 gallons. Further, as shown in FIG. 3D, the size and shape of the reservoir tank 212 provides for a low profile which reduces the overall height of the cleaning device 200. The reduced height of the cleaning device 200 may allow the cleaning device to clean under tables, desks, or in bathroom stalls. Similarly, FIGS. 4A-4B generally show the reservoir tank 412 according to another embodiment of the invention. The depicted reservoir tank 412 is also made of plastic and is rotationally molded. The reservoir tank 412 may also act as a base for the cleaning device. Further, the size and shape of the reservoir tank 412 provides for a low profile which reduces the overall height of the cleaning device.

Figure 4A:
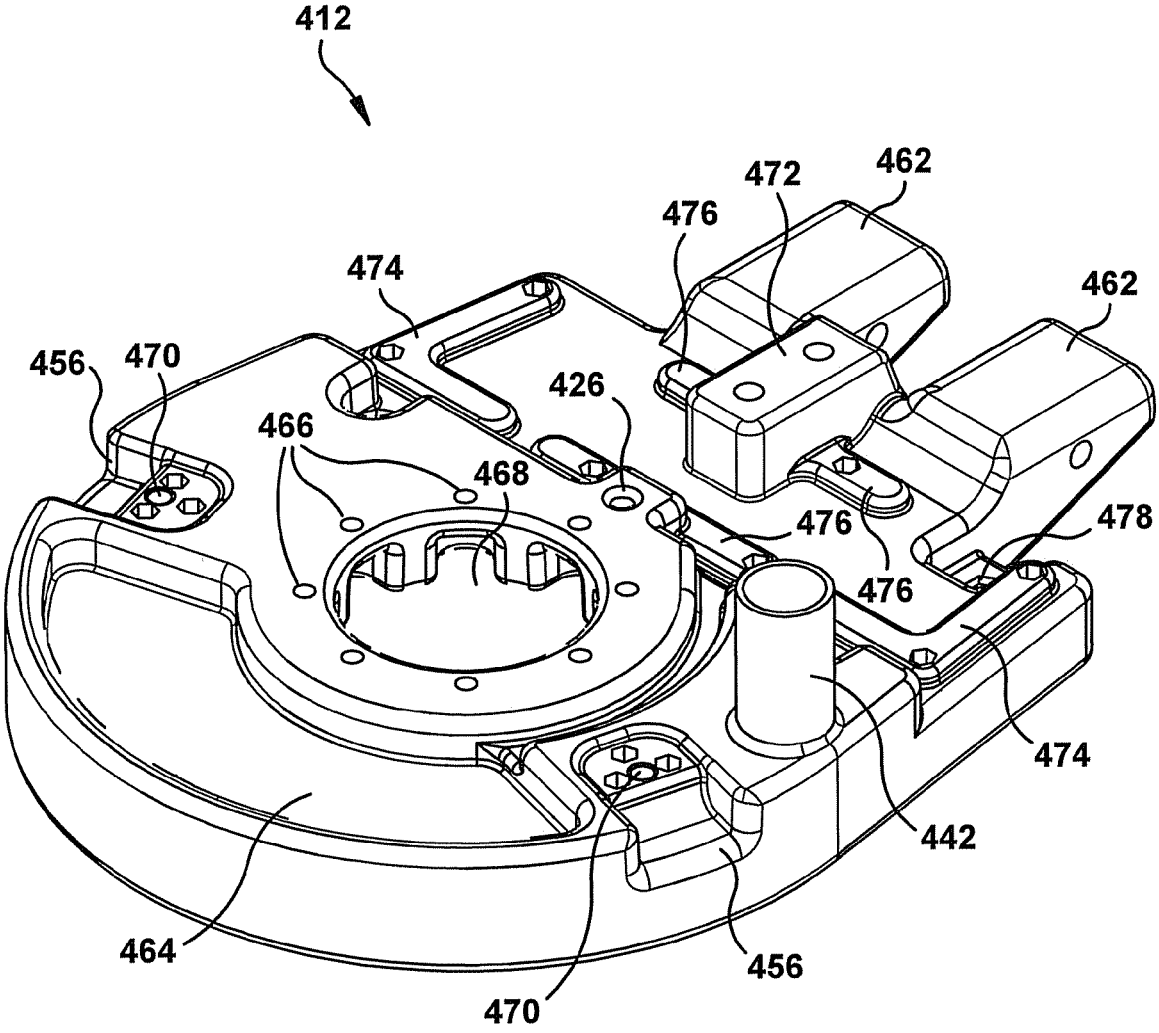
FIGS. 4A-4B are perspective and bottom views, respectively, of a reservoir tank according to another embodiment of the invention.
Figure 4B:
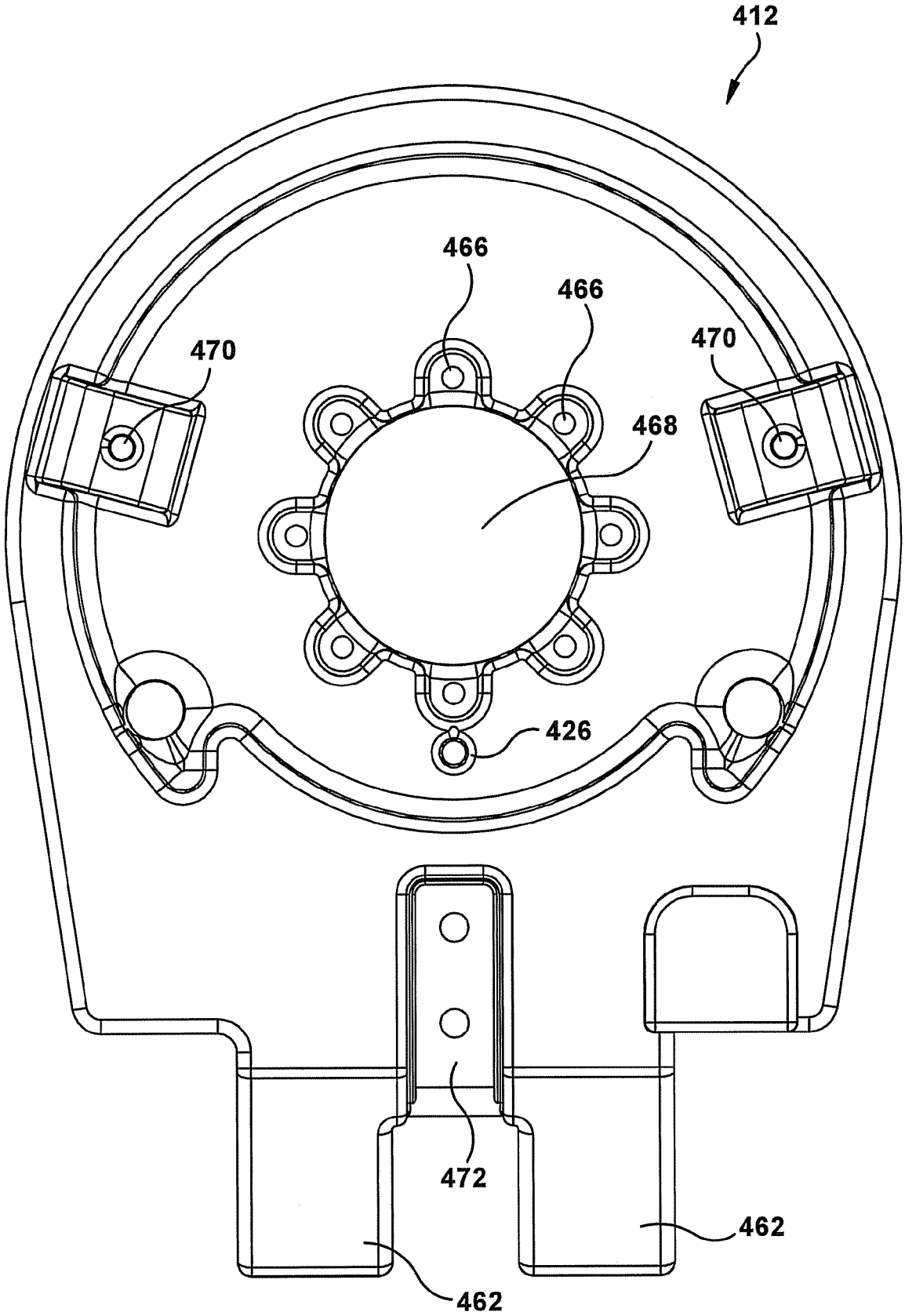

As shown schematically in FIG. 1, the reservoir 111 may have an opening 135 for filling the reservoir with cleaning fluid. The opening 135 may, in some embodiments, be shaped like a spout or funnel and have a cap or lid to prevent spillage. The opening 135 may be located at various places on the reservoir 111. For example, as shown in FIG. 3A, the reservoir tank 212 of cleaning device 200 has a spout 242 for filling the tank with cleaning fluid. As shown, the spout 242 extends upward from the top of the reservoir tank 212. As shown in FIGS. 4A-4B, the spout 442 of reservoir tank 412 also extends upward from the top of the tank. As shown in FIG. 2A, the shape and location of the spout 242 on the reservoir tank 212 allow the tank 212 to be filled without removing the recovery tank 214. As shown, the reservoir tank 212 of the cleaning device 200 has a spout 242 with a vented cap 201 to prevent spillage. The spout 242 also extends upward from the top of the reservoir tank 212 such that the tank may be filled without removing the recovery tank 214.

The reservoir 111 shown schematically in FIG. 1 may also have an opening 137 for receiving a hose 153 from the pump 117. The pump 117 pulls the cleaning fluid from the reservoir 111 through the hose 153. The opening 137 may also have a hose connection or fitting. The opening 137 may be located at various places on the reservoir 111. In many embodiments, the opening 137 is located such that the end of the hose 153 can pull cleaning fluid from the bottom of the reservoir 111.

For example, as shown in FIG. 3A, the reservoir tank 212 of cleaning device 200 has an opening 378 for receiving a hose from a pump 620 (shown in FIG. 6B). As shown, the opening 378 is located towards the lower left corner of the reservoir tank 212. This location and design of the opening 378 allows the pump 620 to pull cleaning fluid from the bottom of the reservoir tank 212 while still maintaining the reduced height of the tank 212. Now referring to FIG. 6A, the opening 378 has a grommet 503 for receiving a connection 607 at the end of the hose 605. The size and shape of the connection 607 may help facilitate pumping fluid from the bottom of the reservoir tank 212. For example, as shown, the connection 607 is shaped such that the end of the connection is towards the bottom of the reservoir tank 212 when the connection is inserted into the opening 378. Further, as shown in FIG. 4A, the reservoir tank 412 has an opening 478 located towards the lower left corner of the tank for receiving a hose from a pump.

In some embodiments, the defined shape of the reservoir tank provides formed shapes within the tank that help prevent movement, or sloshing, of the cleaning fluid inside the tank. As the user moves the cleaning device in back and forth cleaning motions, the cleaning fluid in the tank moves back and forth. This movement of the cleaning fluid alters the center of gravity of the cleaning device and results in the user having less control over the device. The formed shapes within the reservoir tank help prevent this movement of the cleaning fluid and also add to the structural integrity of the reservoir tank.

For example, as shown in FIGS. 3A and 3D, the shapes within the reservoir tank 212 of the cleaning device 200 are collectively formed by various portions of the tank, such as the recovery tank mounting portion 364, notches 256 for the lift rod assemblies 514, apertures 376 for mounting the vertical plate 618, apertures 366 for the brush motor 510, and apertures 374 for mounting the equipment shroud 216, just to name a few. Similarly, now referring to FIG. 4A, the shapes within the reservoir tank 412 are collectively formed by various portions of the tank, such as the recovery tank mounting portion 464, notches 456 for the lift rod assemblies, vertical plate mounting portion 476, apertures 466 for the brush motor, and shroud mounting portion 474, just to name a few.

The recovery tank of the cleaning device is generally a hollow container that stores used fluid suctioned through the extractor from the cleaning surface. The recovery tank may be various shapes and sizes and be located at various places on the cleaning device. The recovery tank may also be made of plastic; however, other suitable materials may be used, such as stainless steel. The recovery tank may be rotationally molded. Of course, the recovery tank may be produced by other methods known in the art, such as injection molding. The recovery tank may also be translucent to allow for easy visualization of the fluid level in the recovery tank.

Figure 7A:
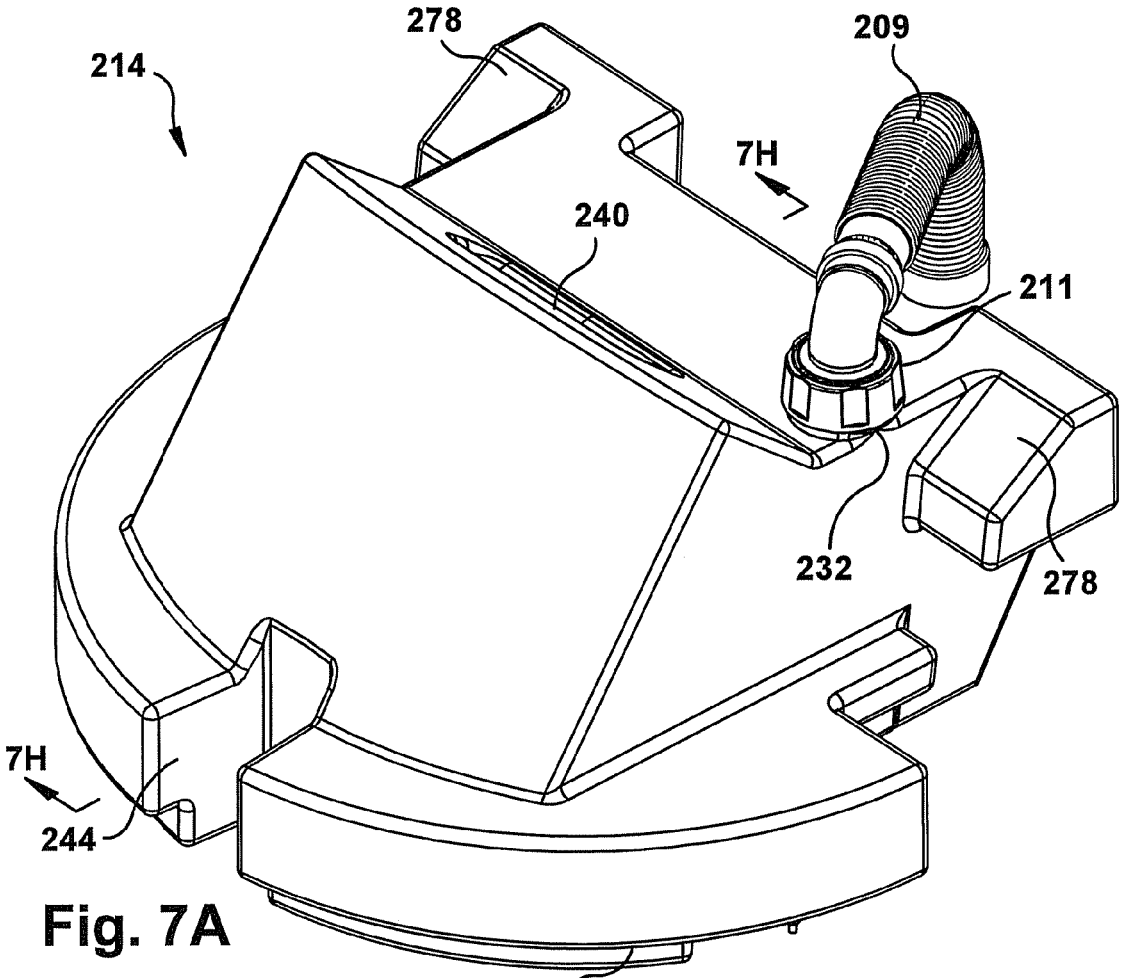
FIGS. 7A-7D are perspective, rear, top, and bottom views, respectively, of a recovery tank of the cleaning device shown in FIGS. 2A-2G.
Figure 7B:
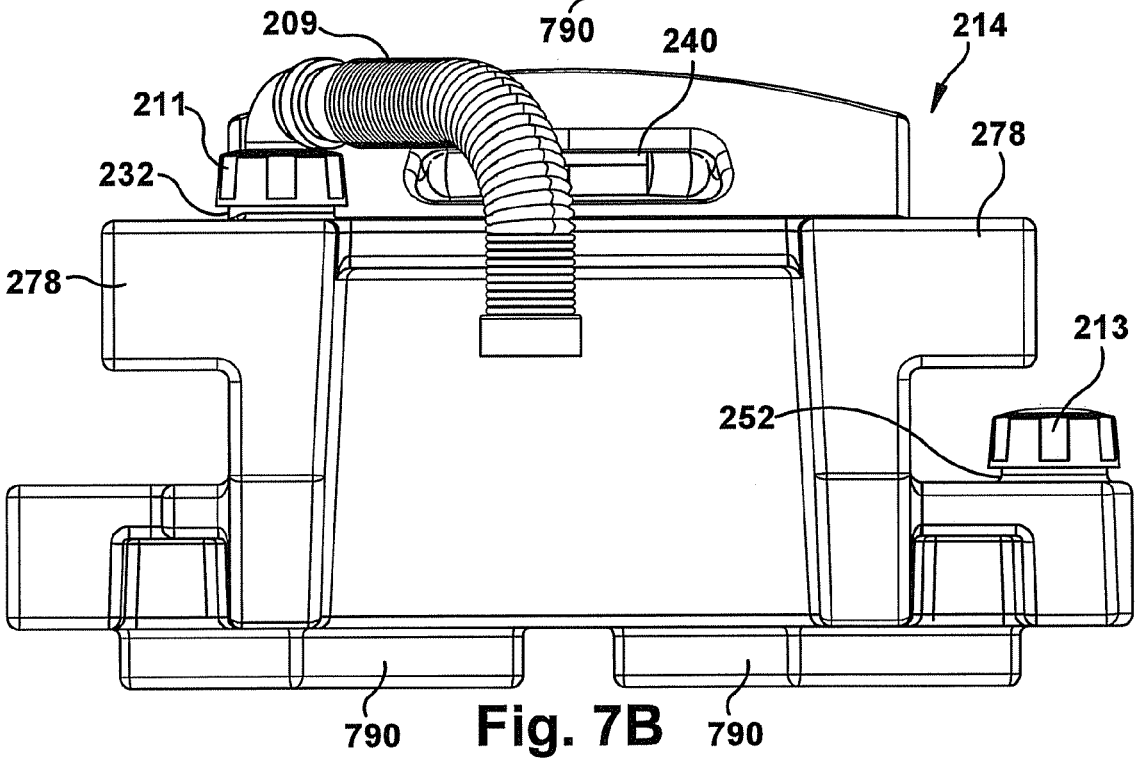
Figure 7C:
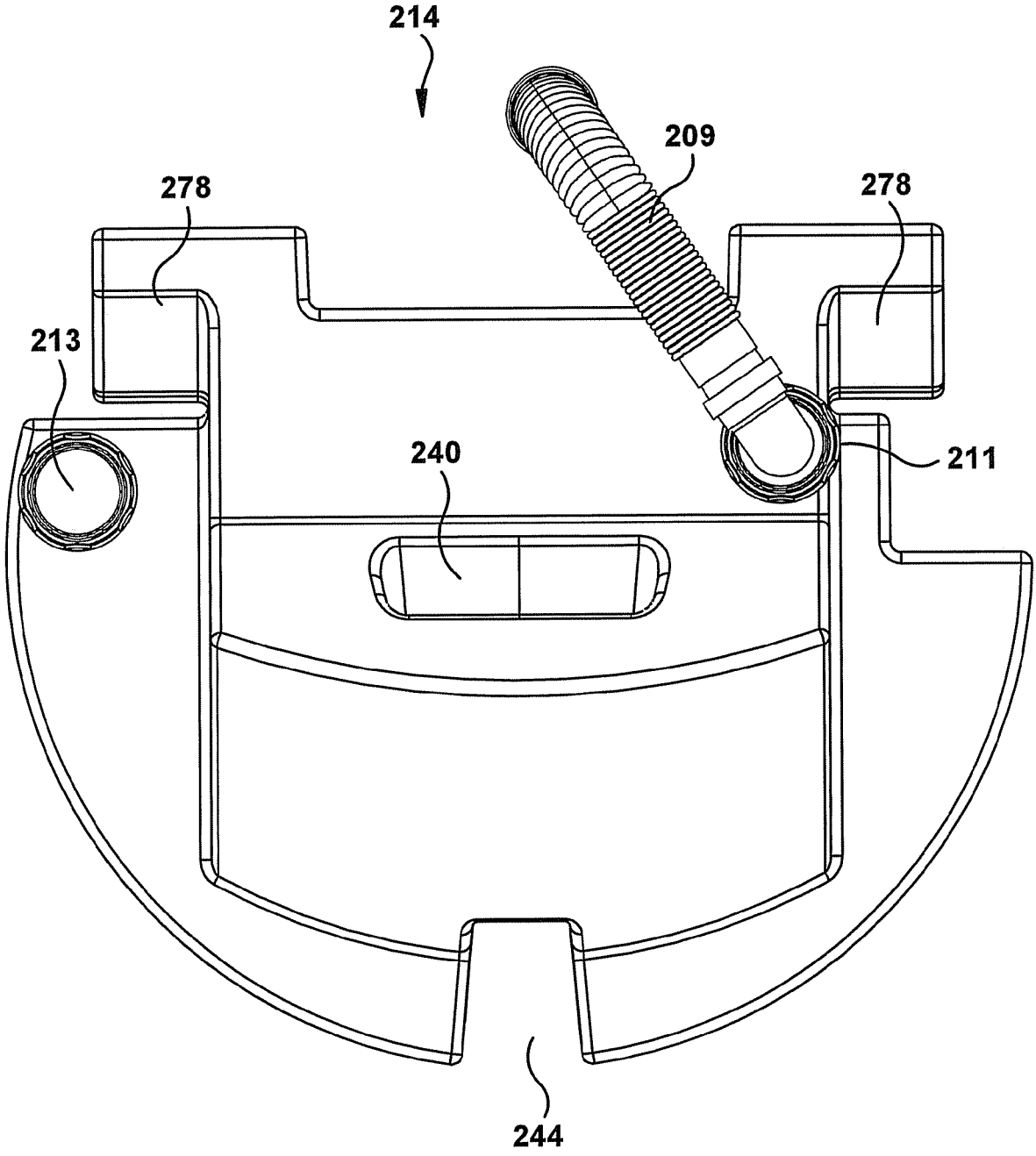
Figure 7D:
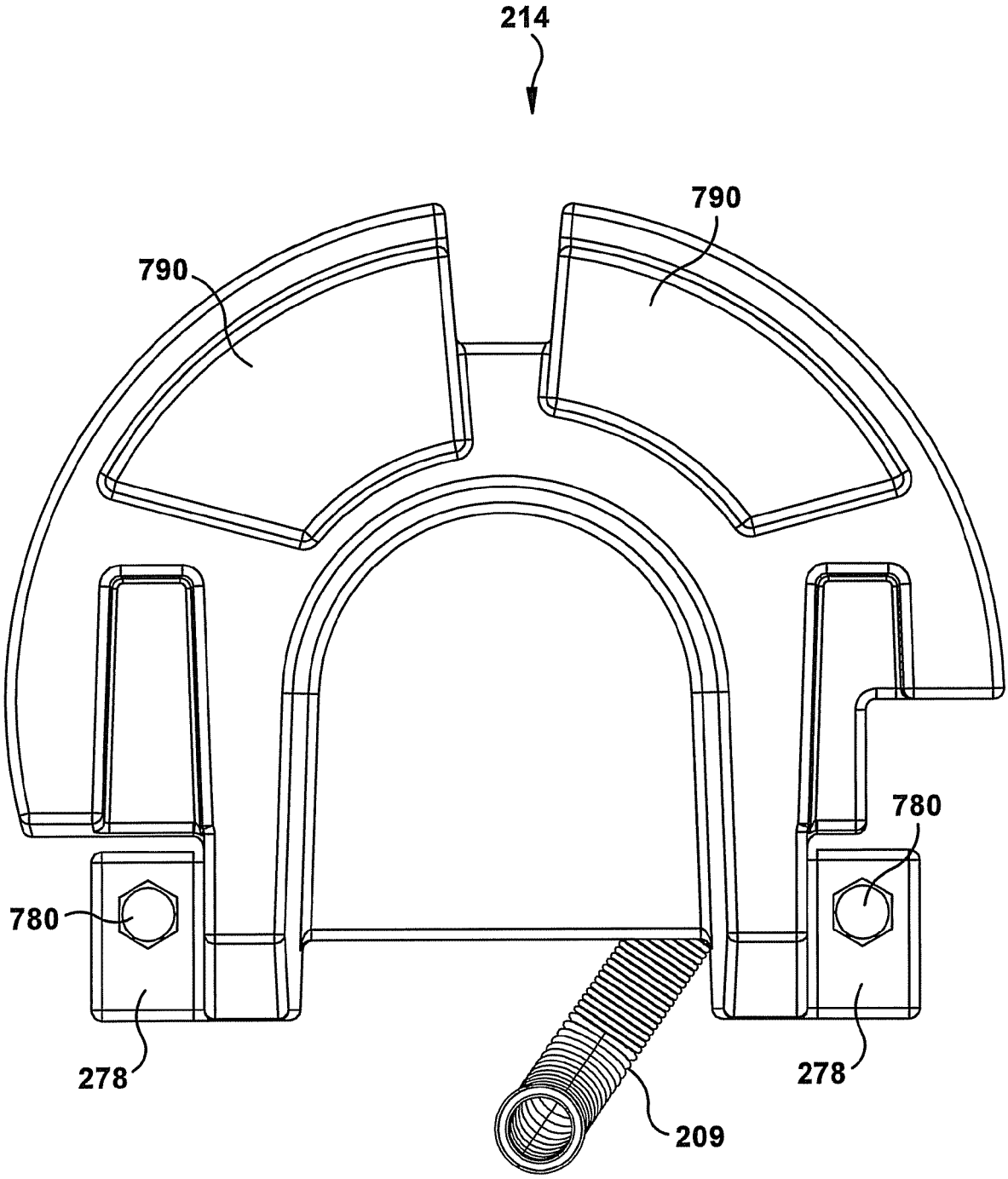
Figure 7E:
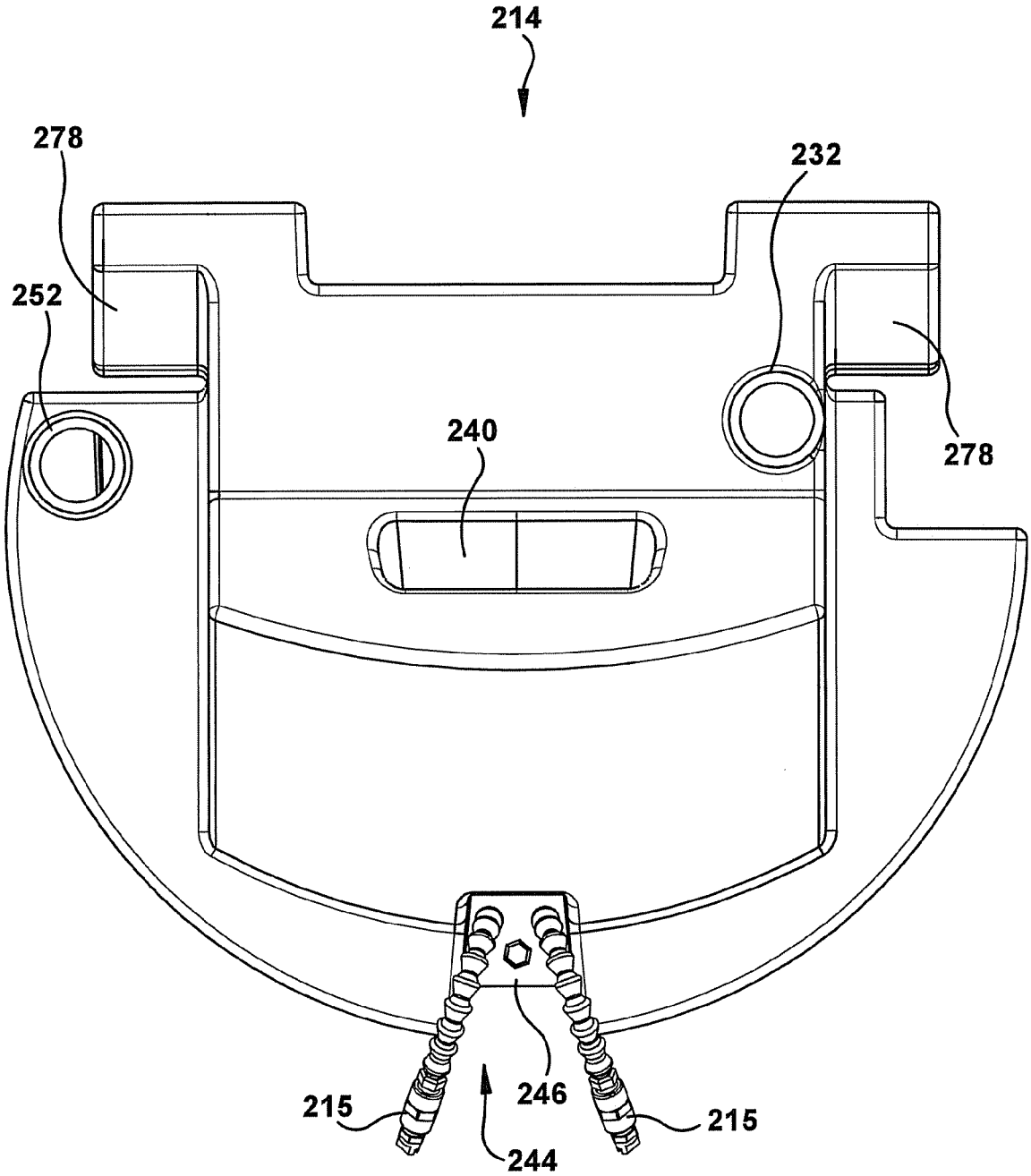
FIGS. 7E-7G are top, rear, and bottom views, respectively, of a nozzle block and nozzles of the cleaning device shown in FIGS. 2A-2G, wherein the nozzle block and the nozzles are positioned in a notch of the recovery tank.
Figure 7F:
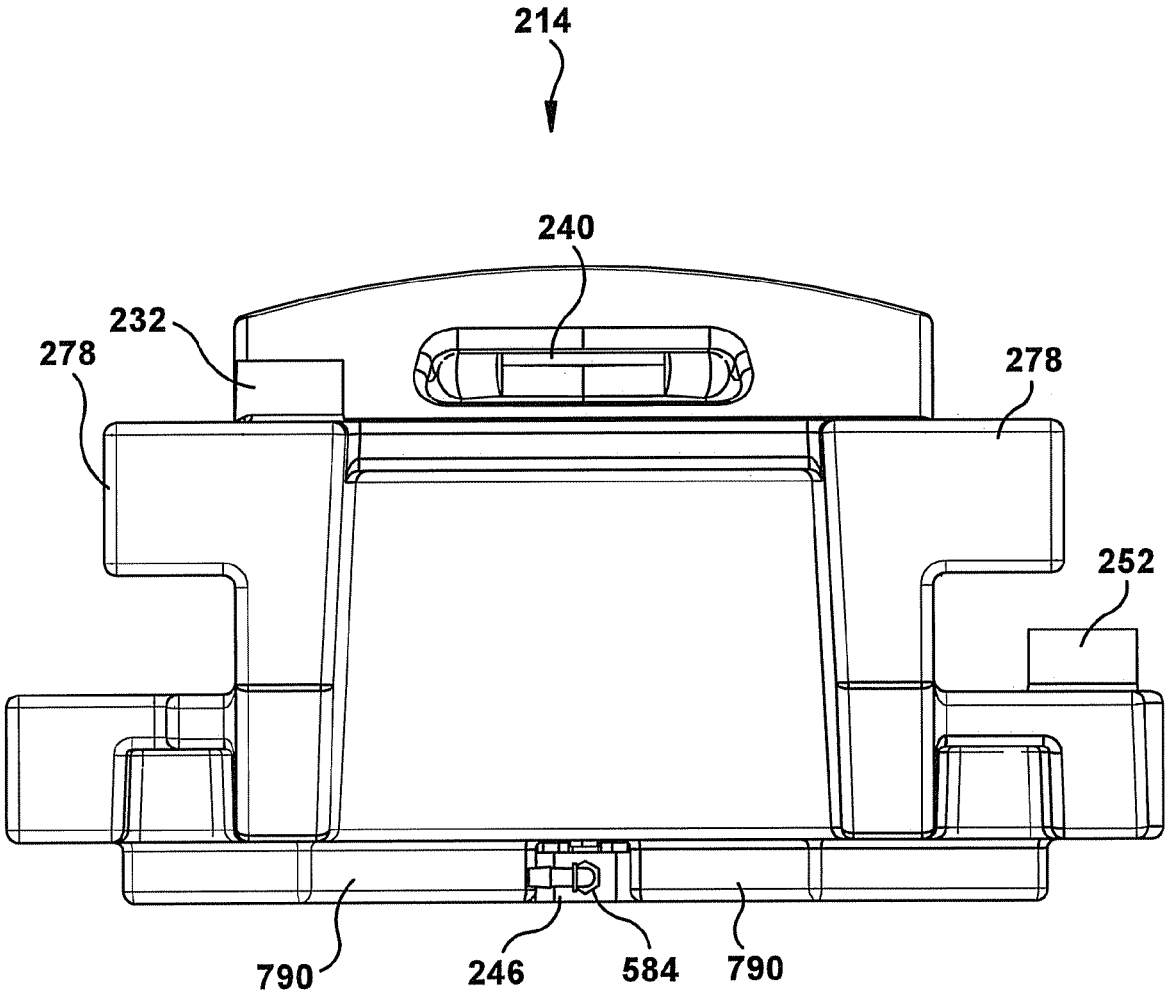
Figure 7G:
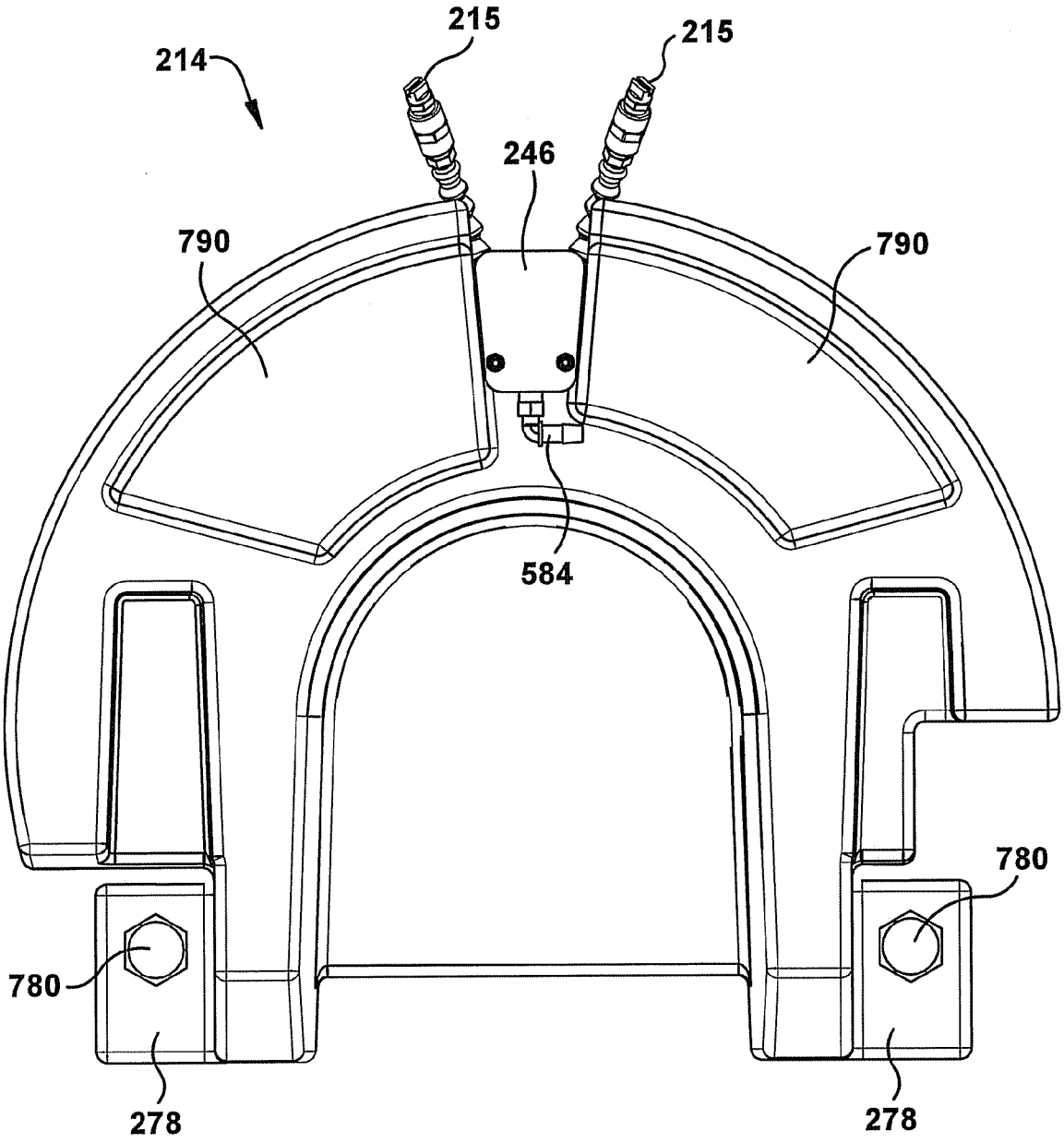
Figure 7H:
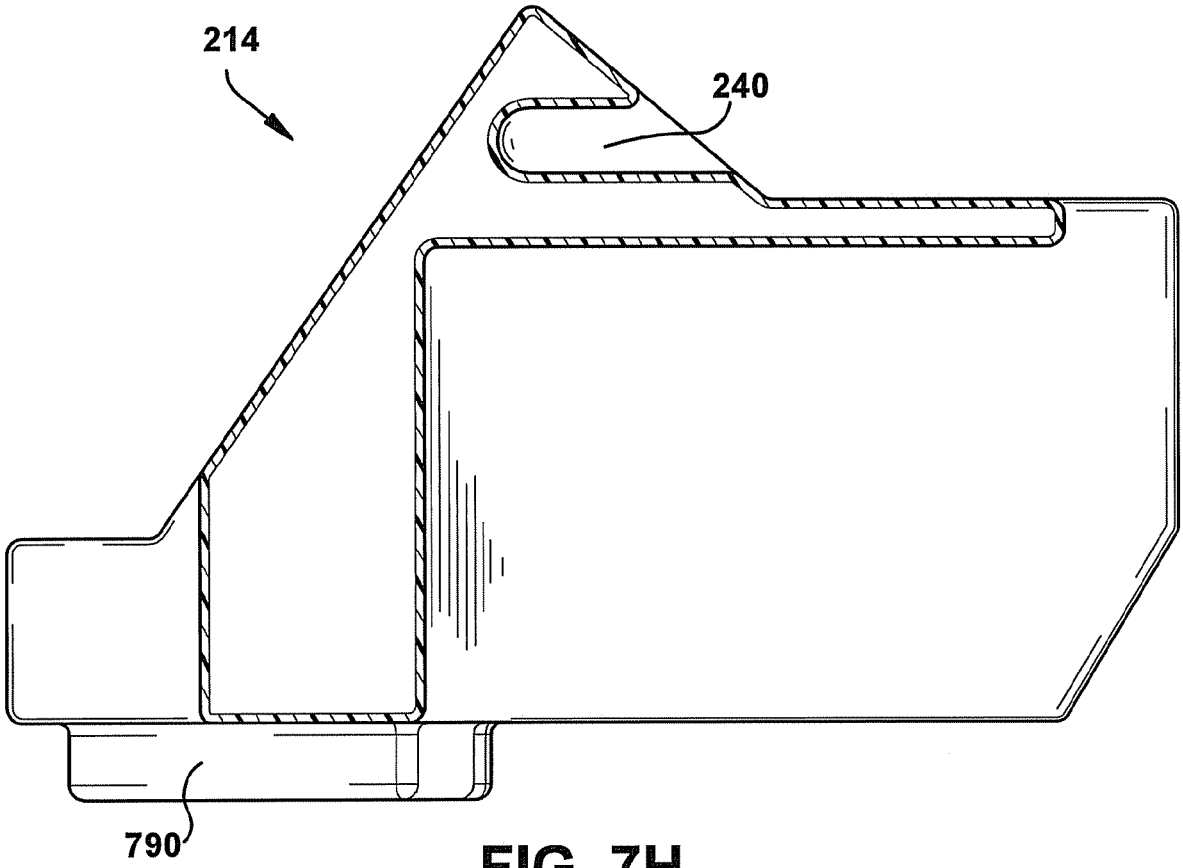
FIG. 7H is a cross sectional view of the recovery tank shown in FIGS. 7A-7D.
Figure 8A:
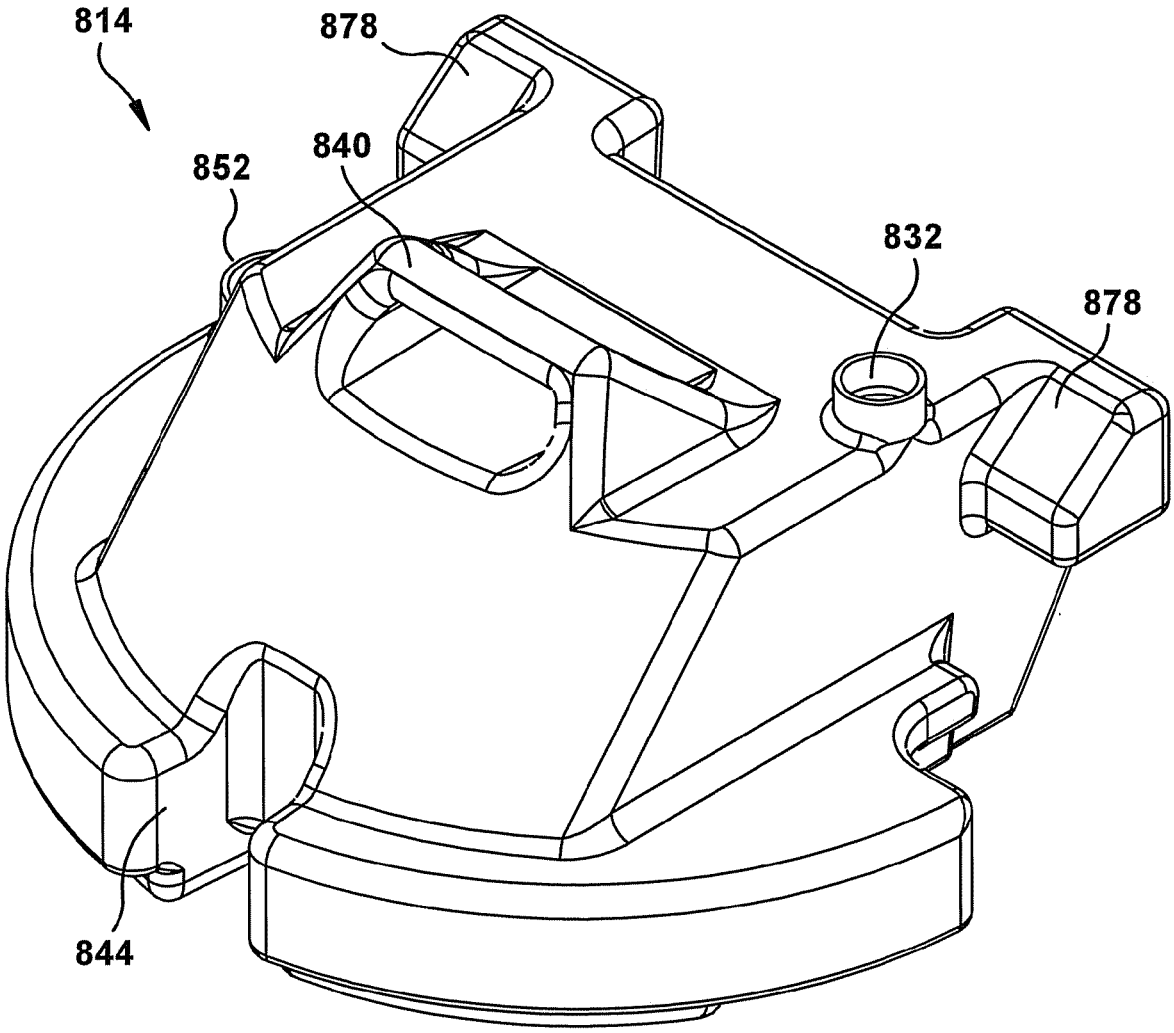
FIGS. 8A-8B are perspective and bottom views, respectively, of a recovery tank according to another embodiment of the invention.
Figure 8B:
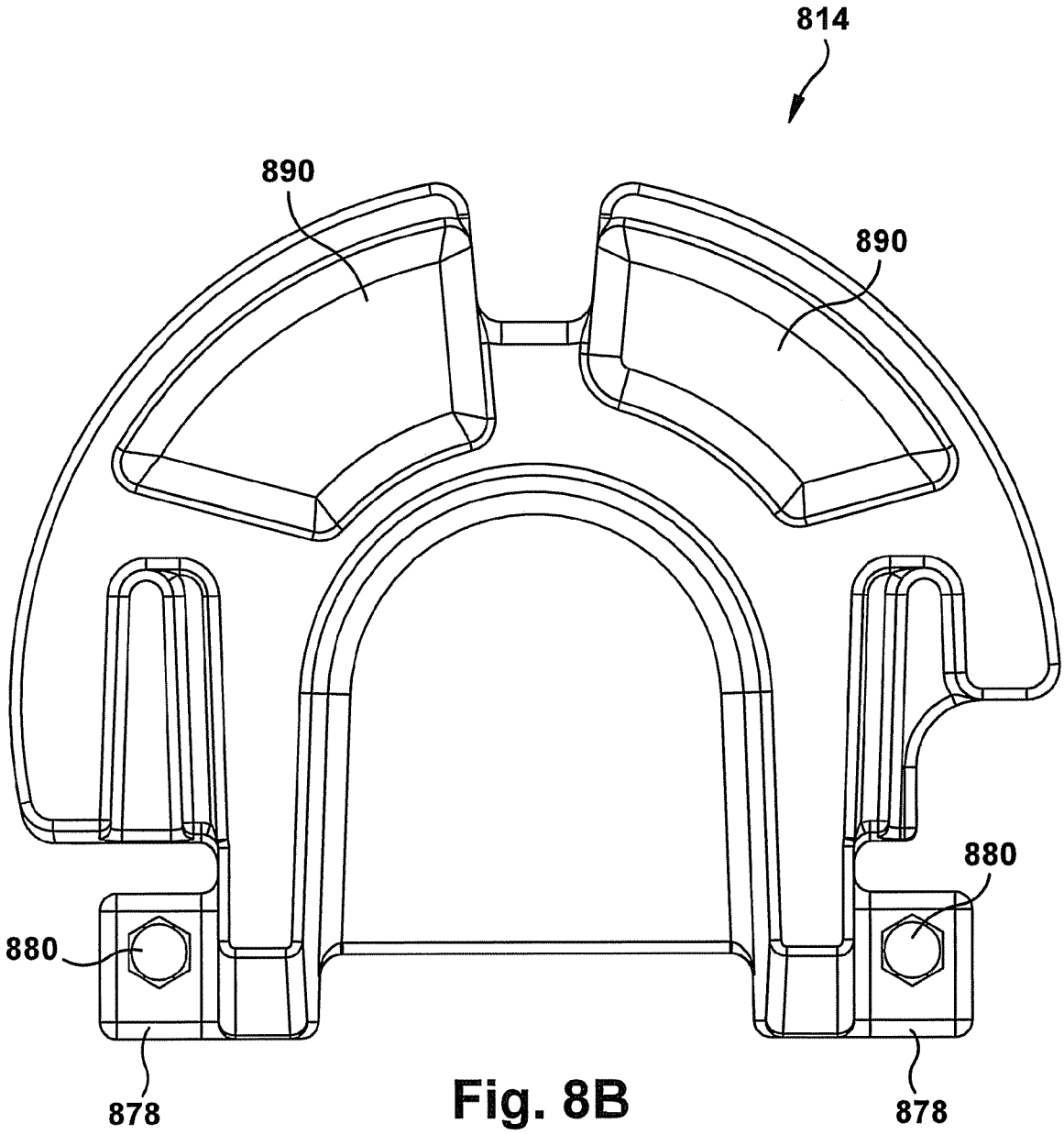

FIGS. 7A-7H generally show the recovery tank 214 of the cleaning device 200, according to an embodiment of the invention. The depicted recovery tank 214 is made of plastic and is rotationally molded. As shown in FIGS. 7B, 7F and 7H, the recovery tank 214 is also formed to fit around a brush motor. As shown in FIG. 2A, the recovery tank 214 sits on the reservoir tank 212 of the cleaning device 200. As such, the weight of the recovery tank 214 and its contents are distributed over the brush 224. In addition, the recovery tank 214 has a low profile. The low profile of the recovery tank 214 reduces the overall height of the cleaning device 200. As shown, the recovery tank 214 has a capacity of approximately 2 gallons. FIGS. 8A-8B generally show a recovery tank 814 according to another embodiment of the invention. The recovery tank 814 is made of plastic, rotationally molded, and formed to fit around the brush motor.

As shown schematically in FIG. 1, the recovery tank 113 may have an opening 157 for emptying the contents of the recovery tank 113. The opening 157 may be shaped like a spout or funnel and have a drain cap or lid to prevent spillage. The opening 157 may also be located various places on the recovery tank 113. For example, as shown in FIG. 7E, a spout 252 extends upward from lower right side of the recovery tank 214 of cleaning device 200. The spout 252 allows the recovery tank 214 to be easily emptied. As shown in FIGS. 7B-7C, the spout 252 has a non-vented drain cap 213 to prevent spillage. Similarly, as shown in FIG. 8A, a spout 852 extends upward from lower right side of the recovery tank 814.

Figure 6A:
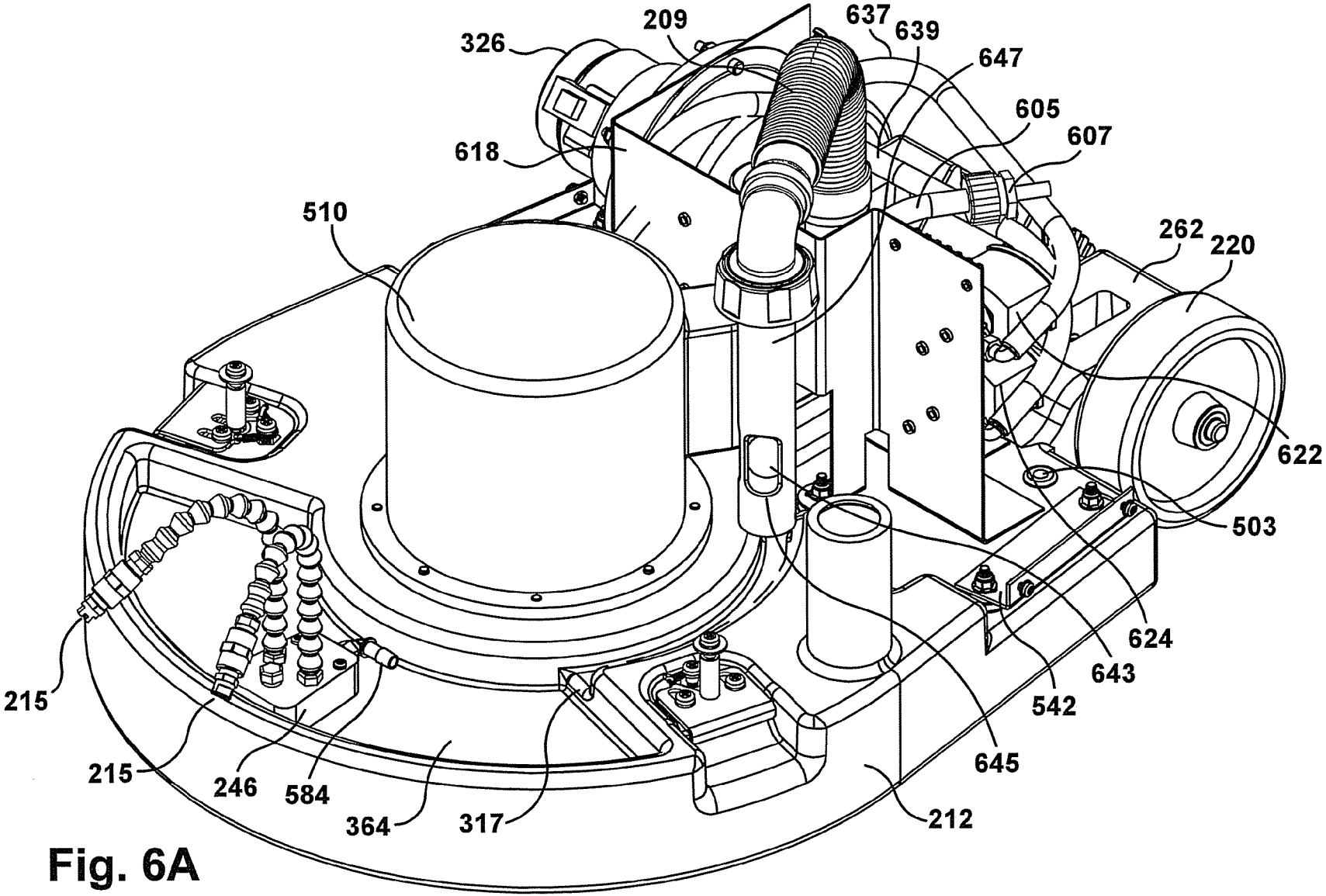
FIGS. 6A-6B are front and rear perspective views, respectively, of the reservoir tank of the cleaning device shown in FIGS. 3A-3D, wherein two equipment shroud mounting brackets and a vertical mounting plate are attached to the reservoir tank.
Figure 6B:
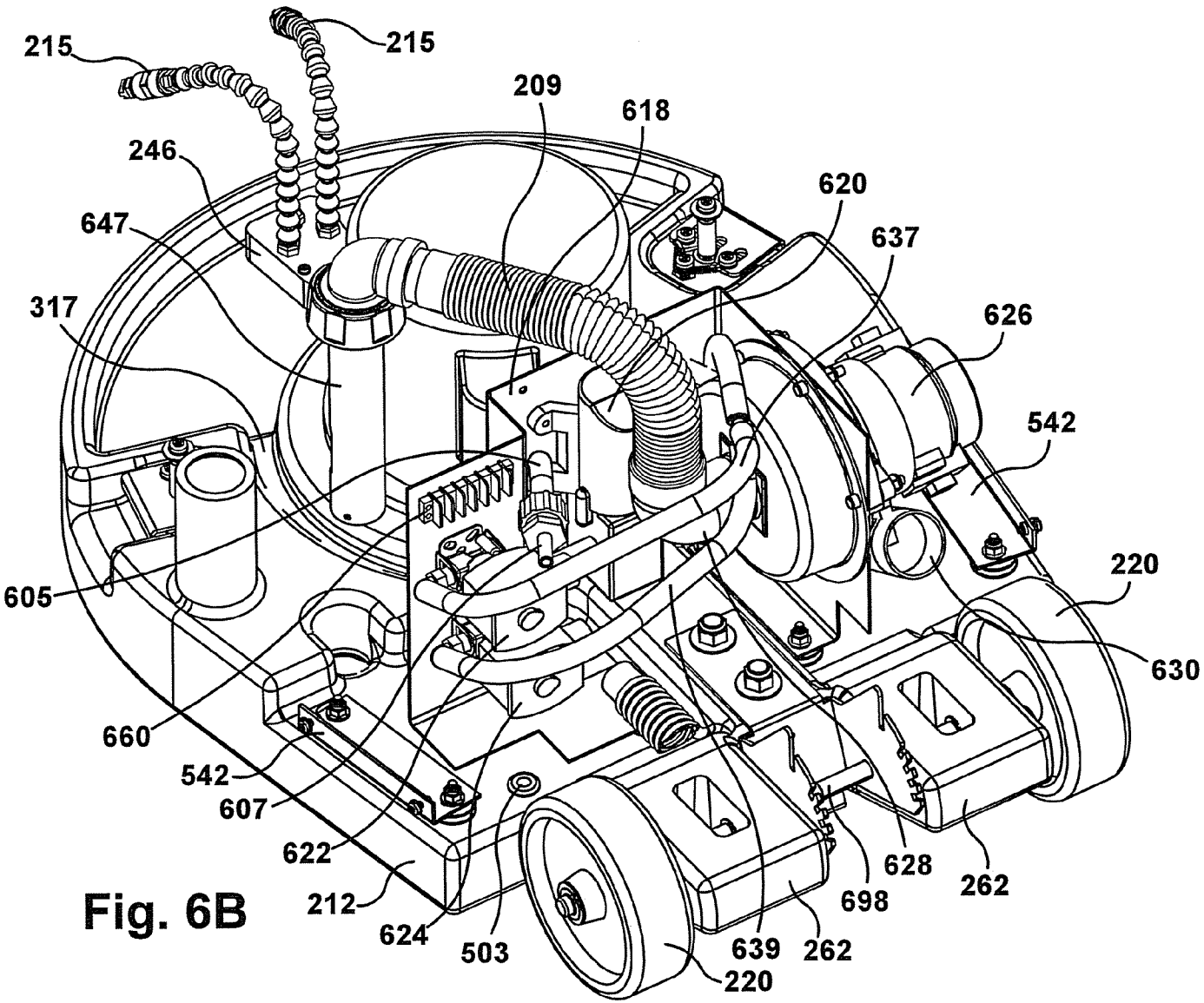

The recovery tank 113 shown schematically in FIG. 1 may also have an opening 149 for receiving a tube 159, such as a corrugated waste tube, from the vacuum device 115. The vacuum device 115 pulls a vacuum through the tube 159 to create a vacuum inside the recovery tank 113. The opening 149 may have a connection or fitting, such as a modified vacuum cap. As shown in FIG. 7A, the recovery tank 214 of the cleaning device 200 has an opening 232 for receiving a corrugated waste tube 209 from the vacuum motor 626. As shown in FIG. 6B, the corrugated waste tube 209 connects to a rigid tube 647 that extends into the recovery tank 214 through the opening 232. As shown in FIG. 7A, the opening 232 has a modified cap 211 that allows the tube 647 to extend into the recovery tank 214. The vacuum motor 626 pulls a vacuum through the corrugated waste tube 209 and the rigid tube 647 to create a vacuum inside the recovery tank 214. Similarly, as shown in FIG. 8A, a recovery tank 814 has an opening 832 for receiving a tube from a vacuum motor.

FIG. 1 also shows that the schematic recovery tank 113 may have at least one opening 147 for receiving a hose 145, such as a corrugated hose, from the extractor 105. The hose 145 from the extractor 105 may be connected to the recovery tank 113 by a connection or fitting. The connection, or fitting, may be any suitable connection, such as a garden hose type connection or a quick disconnect. Similarly, the hose may be connected to the extractor 105 by any suitable connection, or in certain embodiments the hose is formed as part of the extractor 105. Other embodiments may have more or less hoses from the extractor 105 connected to the recovery tank 113. The opening 147 of the recovery tank 113 may be located at various locations on the tank.

For example, as shown in FIG. 7G, the hose mounting portions 278 of the recovery tank 214 have openings 780 for receiving corrugated hoses 288 from the extractor ring 222 of the cleaning device 200. The location of the hose mounting portions 278, towards the top of the recovery tank 214, allows the openings 780 to be clear of the used fluid accumulating towards the bottom of the tank 214. As shown in FIGS. 2C (left side) and 2E (right side), the hoses 288 of the cleaning device 200 may be connected to the recovery tank 214 by a garden hose type connection 234, 236, or fitting (shown in FIG. 9A). Similarly, as shown in FIG. 8B, the hose mounting portions 878 of the recovery tank 814 have openings 880 for receiving the corrugated hoses 888 from an extractor ring of a cleaning device.

The recovery tank generally sits on the base of the cleaning device. For example, as shown in FIG. 7D, mounting portions 790 of the recovery tank 214 of the cleaning device 200 seat in a recovery tank mounting portion 364 of the reservoir tank 212 (shown in FIG. 3A), which acts as the base of the cleaning device. These mounting portions 790 help to stabilize the recovery tank 214. In addition, as shown in FIG. 7H, much of the recovery tank's 214 overall volume is located towards the bottom of the tank 214. Therefore, the fluid in the recovery tank 214 maintains a low center of gravity, which also helps to stabilize the tank. Similarly, as shown in FIG. 8B, the mounting portions 890 of the recovery tank 814 seat in a recovery tank mounting portion 464 of the reservoir tank 412 (shown in FIG. 4A).

In some embodiments, the recovery tank is removable from the cleaning device. A removable recovery tank provides for easier clean out of the tank. Generally, to remove the recovery tank from the cleaning device, the user disconnects the hoses connected to the extractor ring and the tube connected to the vacuum device. These connections may be any suitable connection, such as a garden hose type connection or a quick disconnect. For example, as shown in FIG. 2A, the depicted recovery tank 214 may be removed from the cleaning device 200 by disconnecting the hoses 288 connected to the extractor ring 222 and a tube 209 connected to the vacuum motor 626. As shown in FIG. 2B, the hoses 288 from the extractor ring are connected to the recovery tank 214 by garden hose type connections 234, 236 (shown in FIG. 9A). Also, the tube 209 from the vacuum motor 626 is connected to the recovery tank 214 by a modified cap 211.

The recovery tank may also have a handle for easier handling during clean out of the tank. For example, as shown in FIG. 2F, the recovery tank 214 of the cleaning device 200 has a handle 240 on top. As shown, the handle 240 is formed as part of the recovery tank 214. Similarly, as shown in FIG. 8A, the recovery tank 814 has a handle 840 formed as part of the tank.

In some embodiments, the recovery tank may also have a notch defined in the front of the tank for at least one nozzle that dispenses cleaning fluid onto the cleaning surface. Generally, a nozzle block is mounted on the reservoir tank with a nozzle extending from the block. The nozzle is protected by the notch in the recovery tank. Of course, any other apparatus capable of dispensing fluid may be used. In certain embodiments, the recovery tank may comprise a flange for mounting the nozzle block. In still other embodiments, the nozzle block may be formed as part of the recovery tank.

Figure 5A:
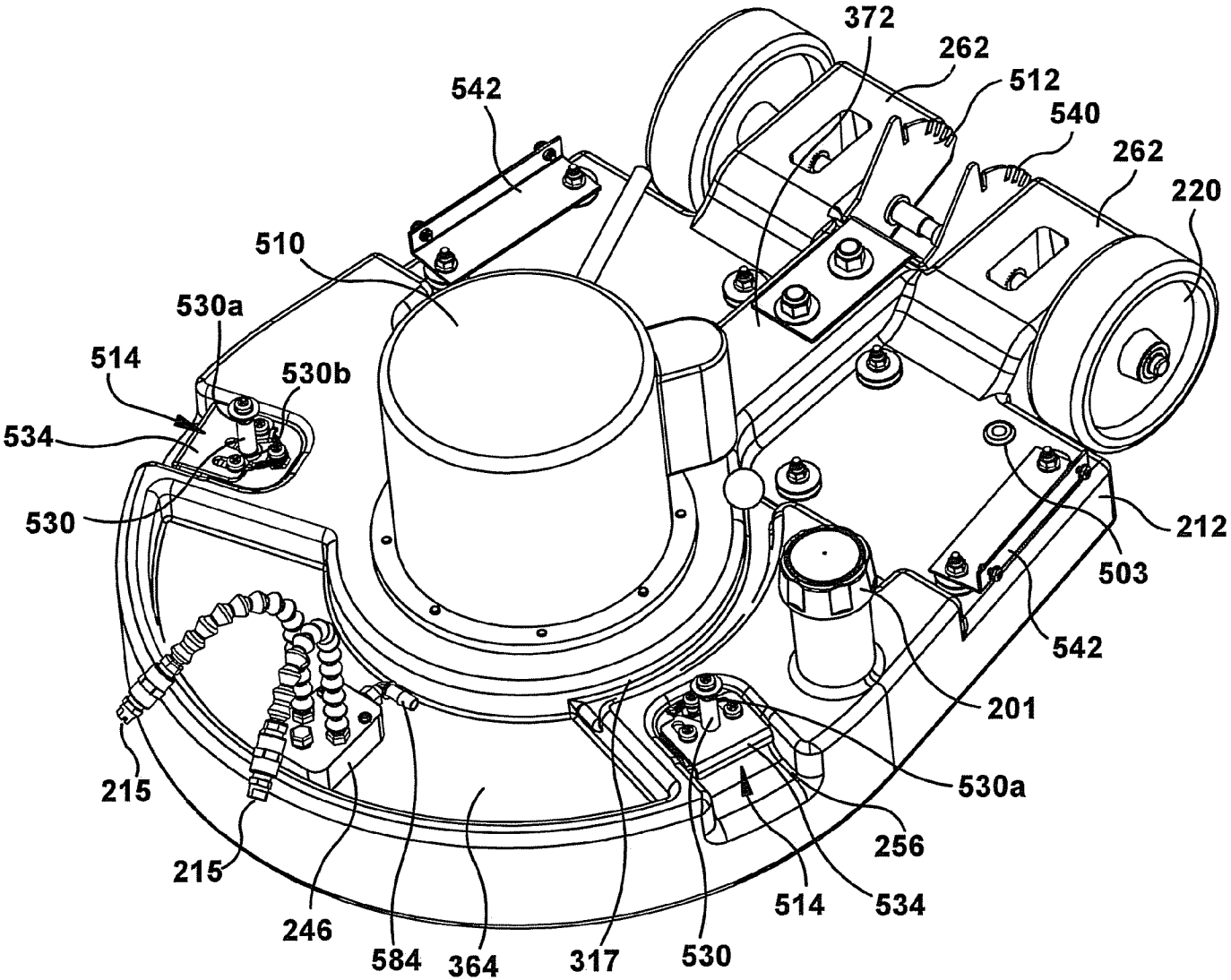
FIG. 5A is a perspective view of the reservoir tank shown in FIGS. 3A-3D, wherein a brush motor, two lift rod assemblies, a handle mounting bracket, a nozzle block, and an axle with two wheels are attached to the reservoir tank.

As shown in FIG. 5A, the nozzle block 246 is mounted to the top of the reservoir tank 212 of the cleaning device 200 and is positioned in the notch 244 (shown in FIG. 7E). As shown in FIG. 3A, apertures 386 in the reservoir tank 212 allow the block to be attached to the tank. As shown in FIG. 6A, the reservoir tank 212 also has a channel 317 for the hose connecting the nozzle block 246 to valve 624. The channel 317 helps prevent the hose from pinching between the reservoir tank 212 and the recovery tank 214. As shown in FIG. 5A, the nozzle block 246 also has antenna type spray nozzles 215 extending from openings on the top of the block 246 for dispensing cleaning fluid from the reservoir tank 212 to the cleaning surface. As shown, two spray nozzles 215 extend from the nozzle block 246. However, more or less spray nozzles may be used of various sizes. Similarly, as shown in FIG. 8A, a nozzle block may be mounted to the top of a reservoir tank and positioned in a notch 844 defined in the front of the recovery tank 814.

As shown schematically in FIG. 1, the recovery tank 113 may have fluid height detectors 163. In certain embodiments, the recovery tank 113 has electrical sensors or switches attached to the tank 113 that detect the amount of fluid in the tank. In other embodiments, marks on the recovery tank 113 indicate the height and/or amount of fluid in the tank.

The extractor of the cleaning device is generally hollow and suctions used fluid from the cleaning surface into the recovery tank. The vacuum created by the vacuum device pulls the used fluid through holes or slots in the extractor and into the recovery tank. The extractor may generally be raised and lowered relative to the cleaning surface. The extractor may also be biased, such as with a spring, downward, or against the cleaning surface. The extractor may be made of plastic; however, other suitable materials may be used, such as stainless steel. The extractor may also be rotationally molded. Of course, the extractor may be produced by other methods, such as injection molding. The extractor may also be various shapes and sizes, such as circular or ring shaped.

Figure 10A:
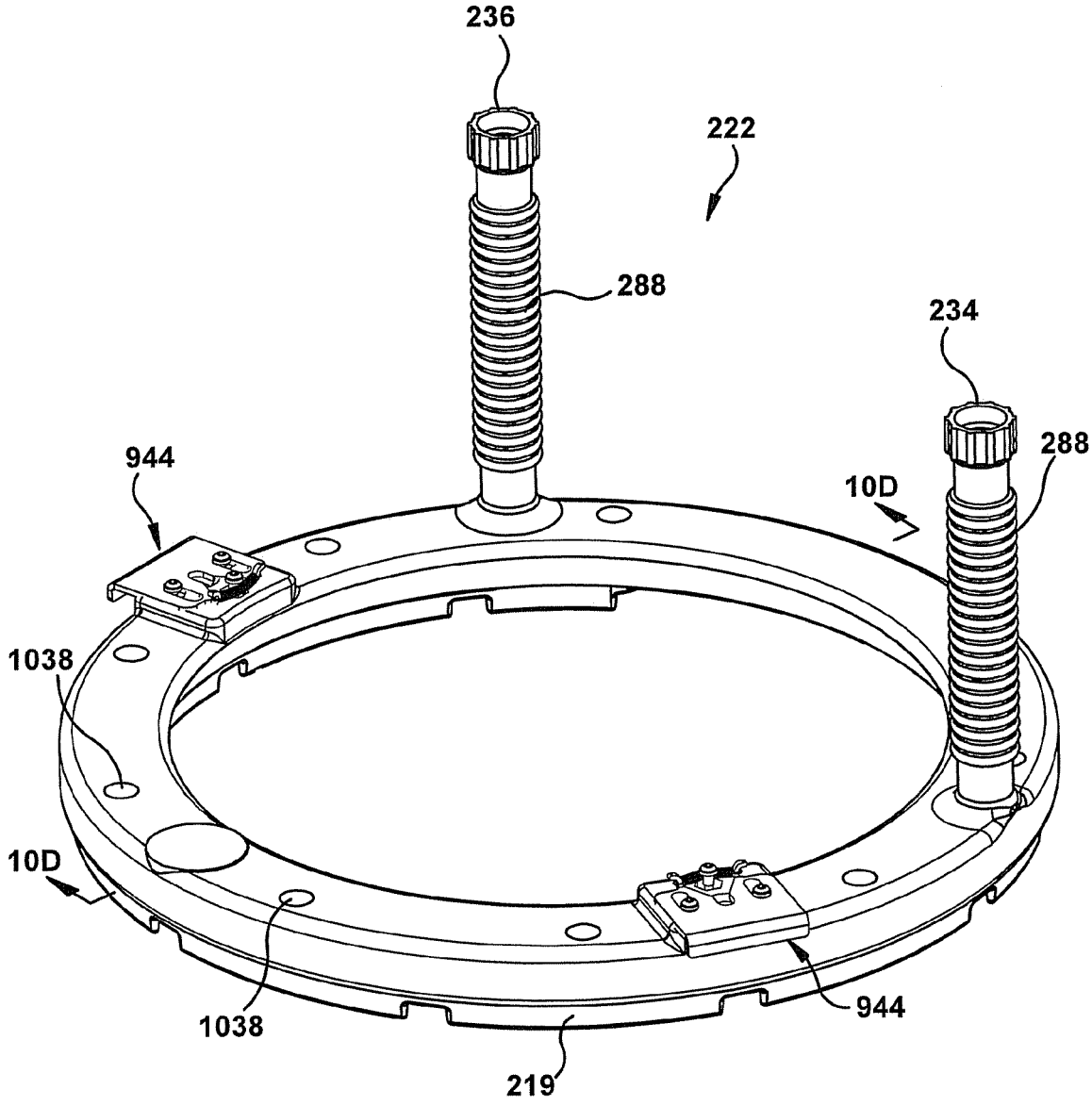
FIGS. 10A-10C are perspective, top, and bottom views, respectively, of the extractor ring of the cleaning device shown in FIGS. 2A-2G.
Figure 10B:
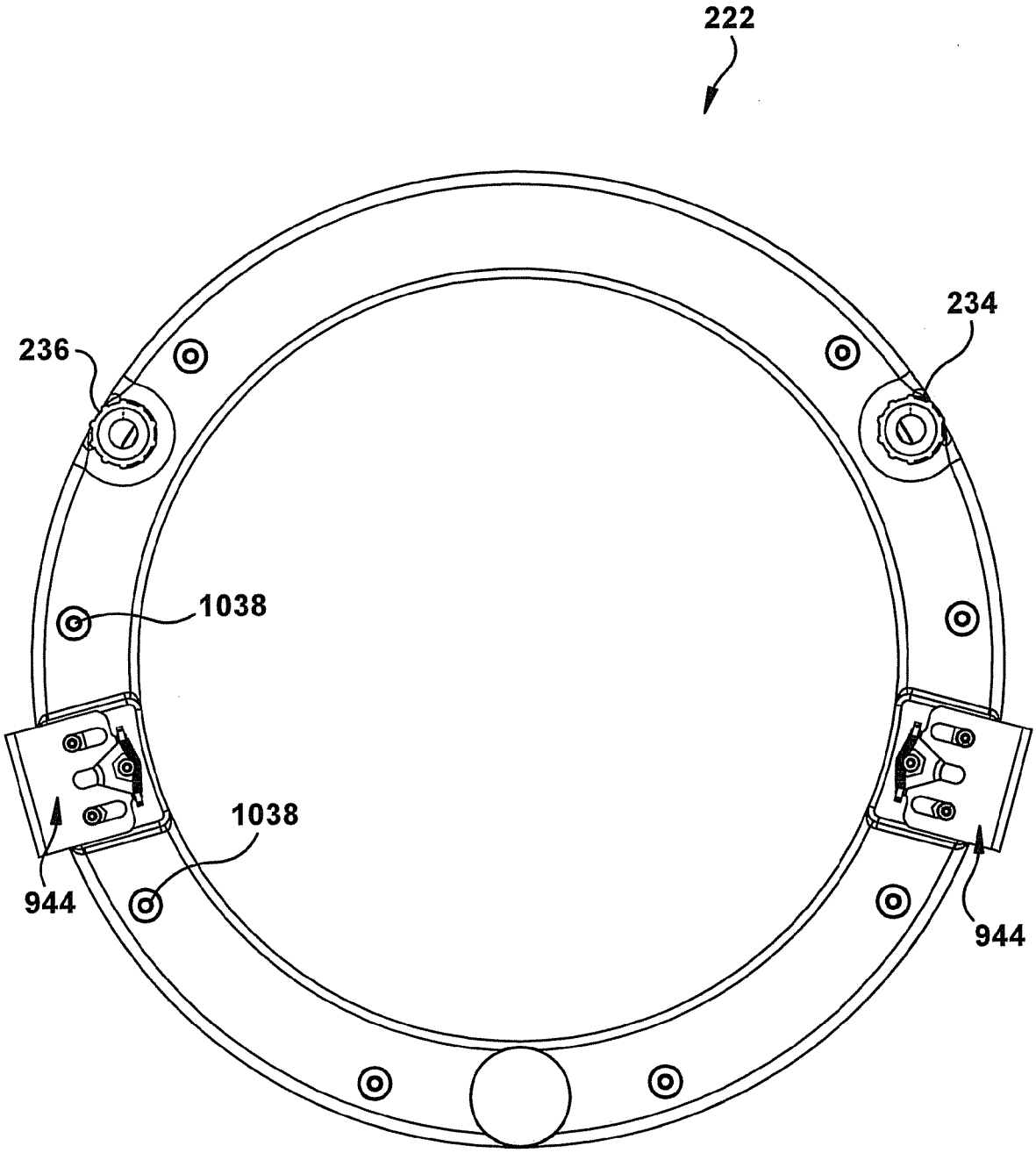
Figure 10C:
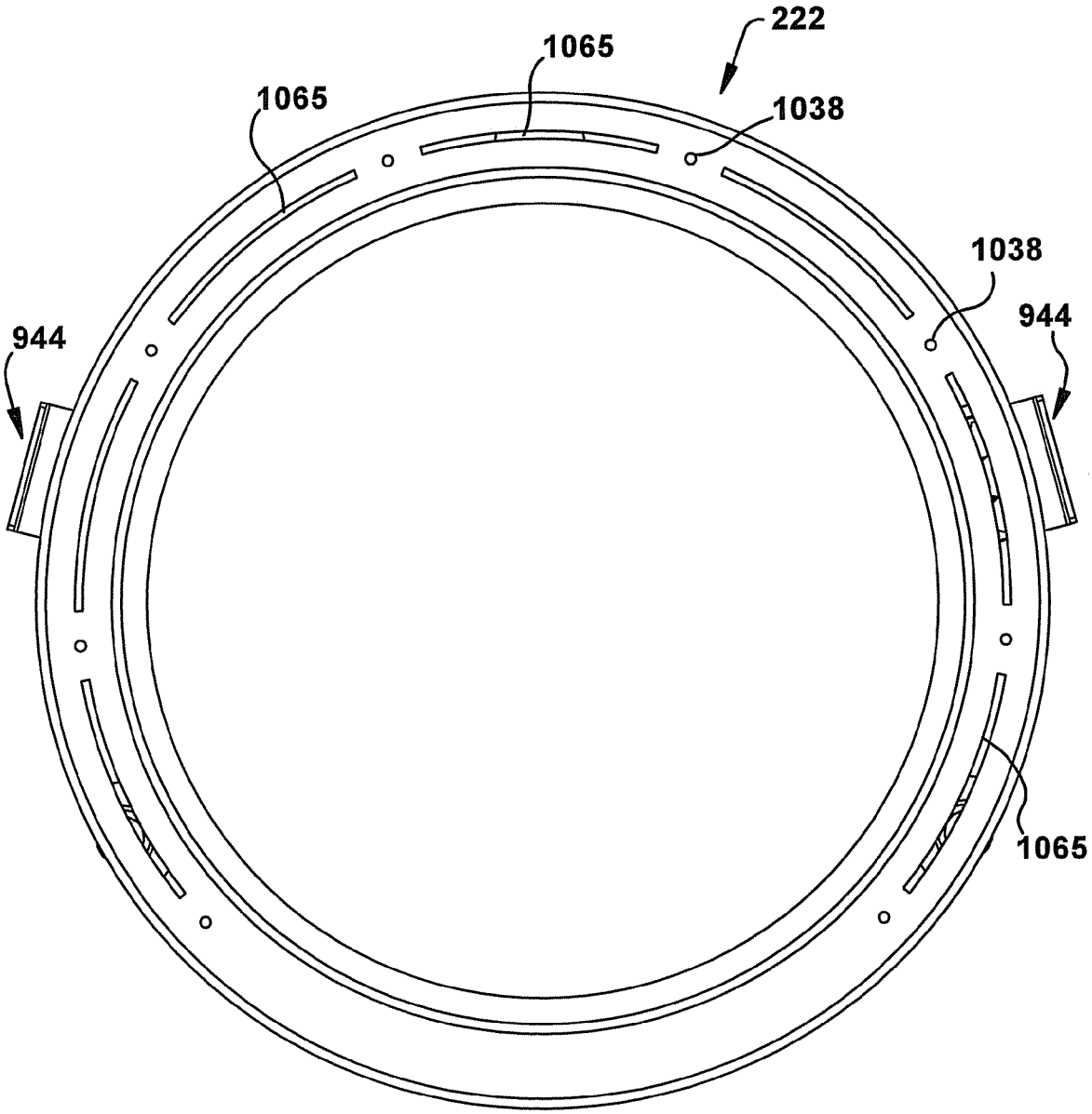
Figure 10D:
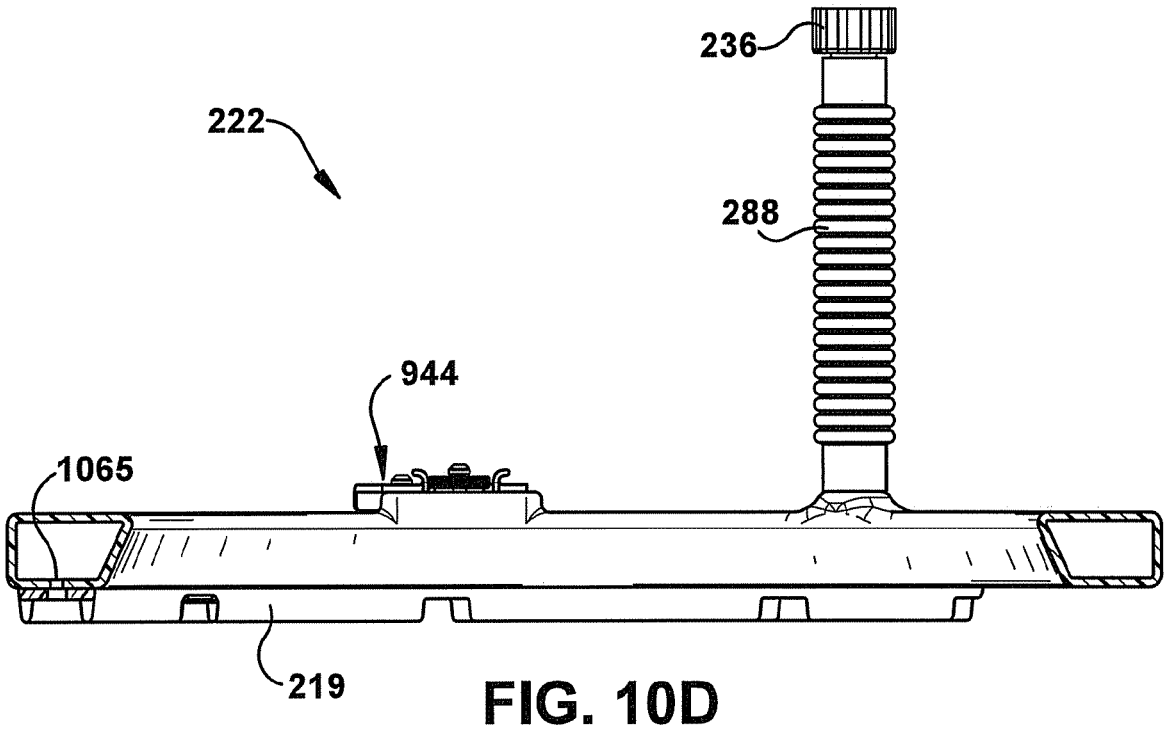
FIG. 10D is a cross sectional view of the extractor ring shown in FIGS. 10A-10C.
Figure 11A:
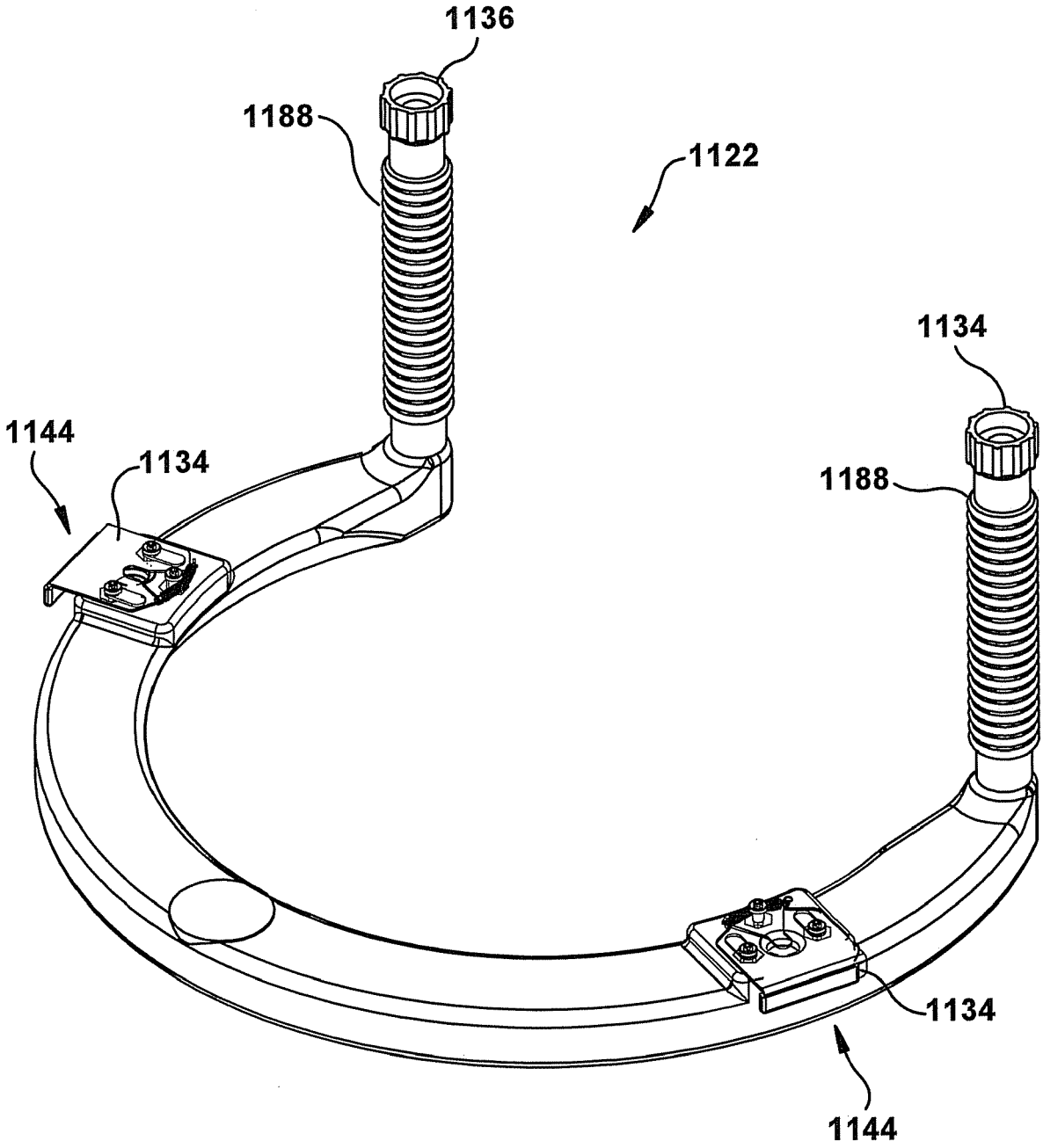
FIGS. 11A-11B are perspective and bottom views, respectively, of an extractor ring according to another embodiment of the invention.
Figure 11B:
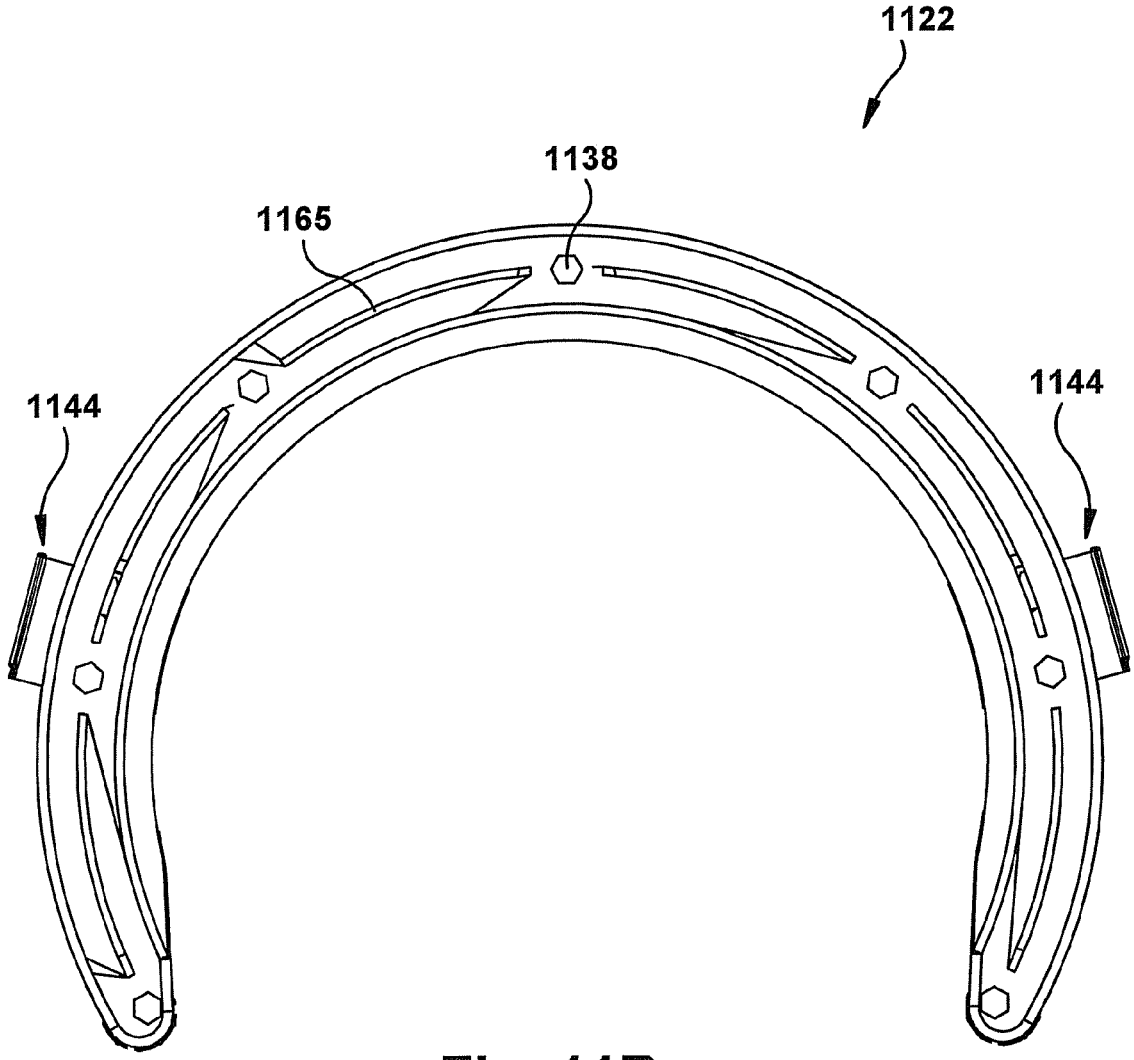

FIGS. 10A-10D generally show an extractor ring 222 of the cleaning device 200. As shown in FIGS. 10C and 10D, the extractor ring 222 is a hollow circular ring made of plastic which has slots 1065 in the bottom through which used fluid from the cleaning surface is suctioned. Similarly, FIGS. 11A-11B show an extractor ring 1122 according to another embodiment of the invention. As shown, the extractor ring 1122 is a partial circular ring made of plastic having slots 1165 in the bottom.

Figure 5B:
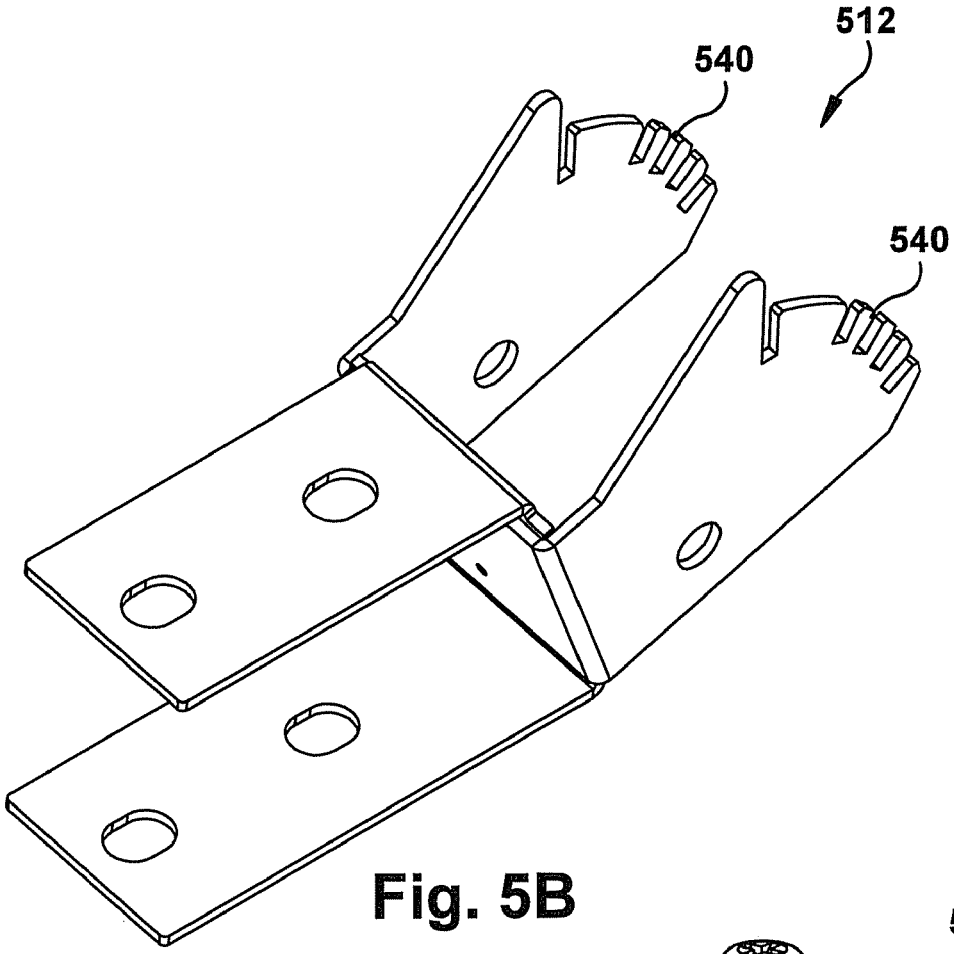
FIG. 5B is a perspective view of the handle mounting bracket shown in FIG. 5A.
Figure 5C:
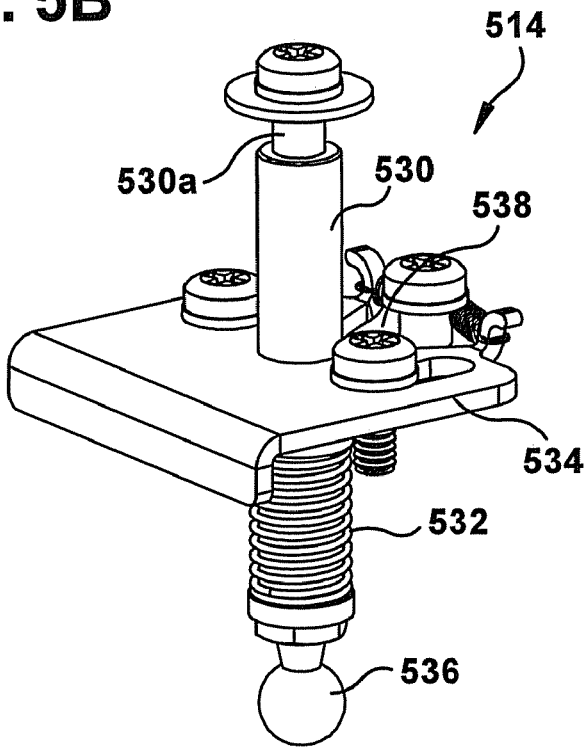
FIG. 5C is a perspective view of the lift rod assembly shown in FIG. 5A.
Figure 9A:
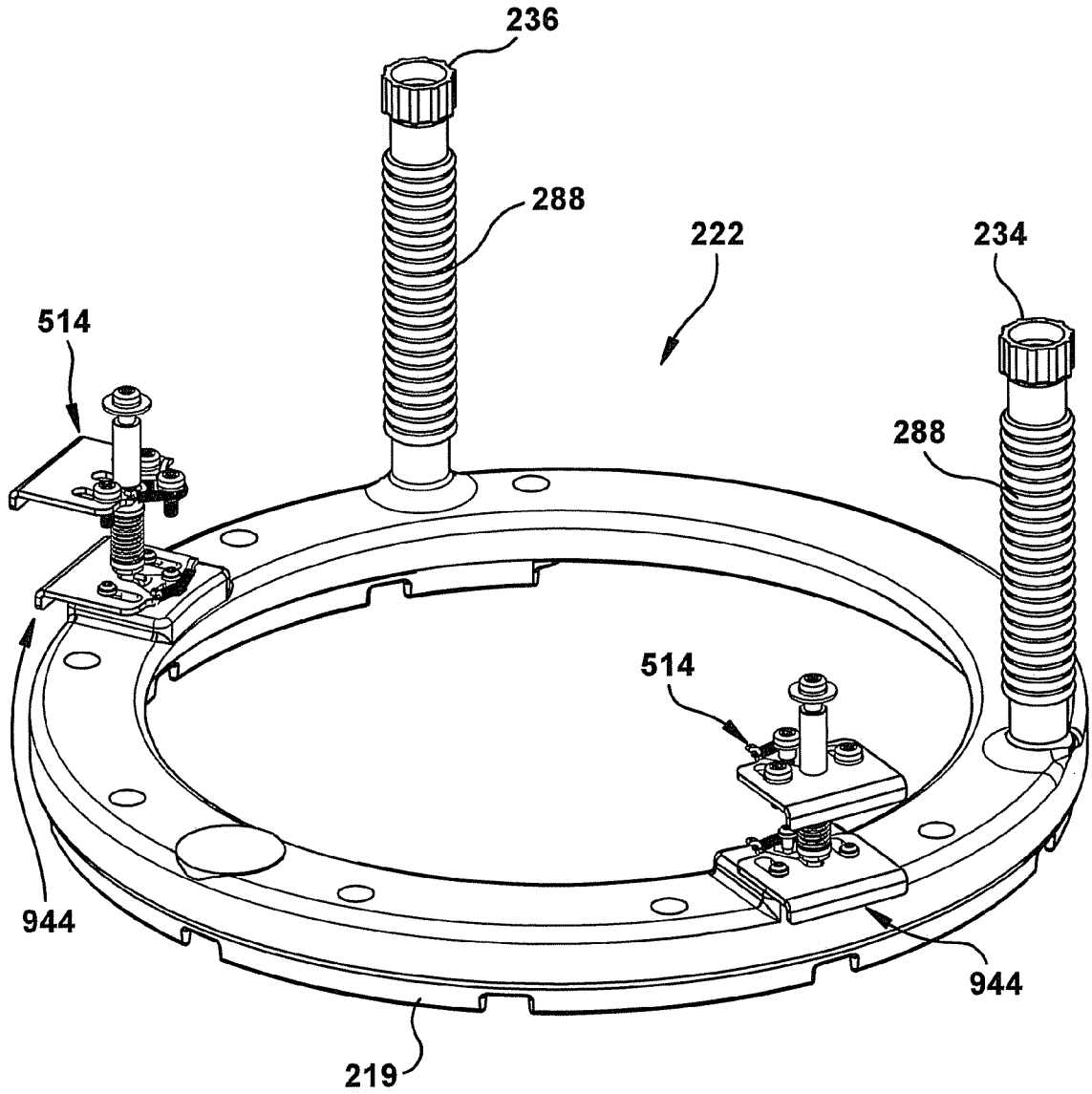
FIG. 9A is a perspective view of an extractor ring and two lift rod assemblies of the cleaning device shown in FIGS. 2A-2G.
Figure 9B:
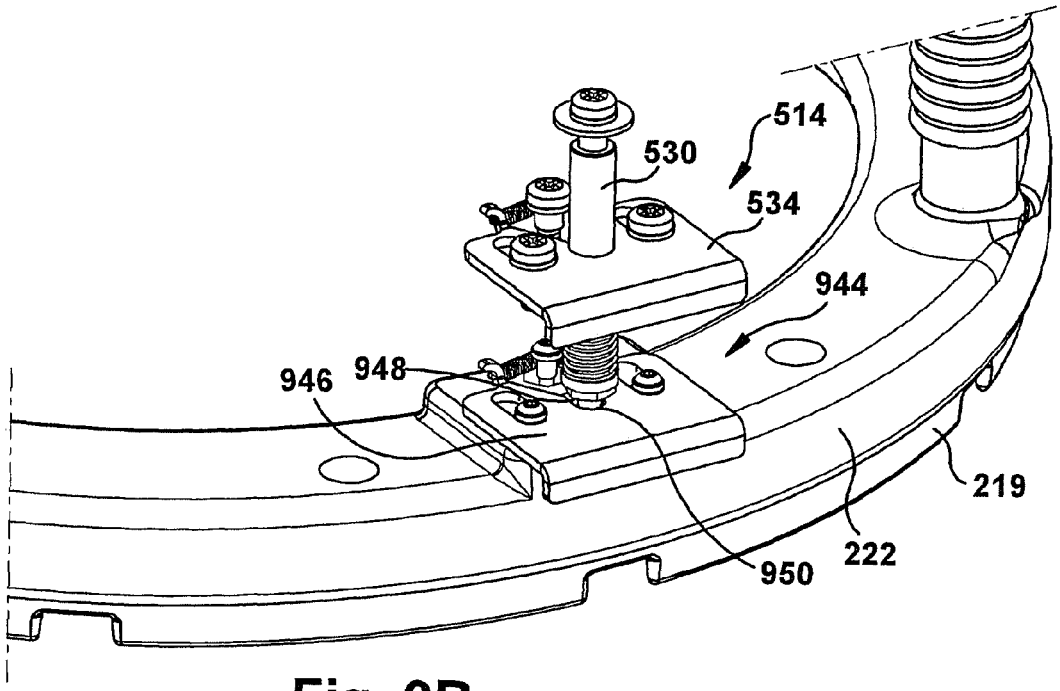
FIGS. 9B-9C are perspective views of a lift rod assembly and a lift rod attachment assembly of the cleaning device shown in FIGS. 2A-2G, wherein a clasp and spring are removed in FIG. 9C.
Figure 9C:
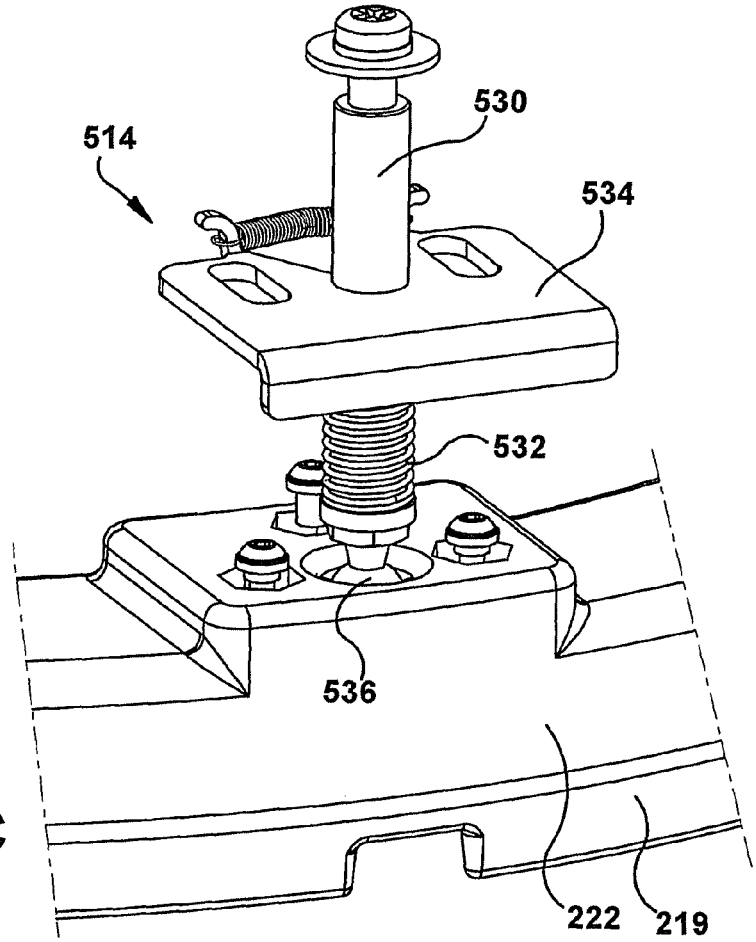

Lift rod, or support member, assemblies are generally attached to the reservoir tank and allow the extractor to be raised and lowered relative to the reservoir tank. Various configurations of support members, such as members with different cross sectional shapes, may be used in the practice of this invention. As shown in FIG. 5C, each lift rod assembly 514 of cleaning device 200 includes a lift rod 530, a spring 532, a head 536, and a spring loaded clasp 534. As will be discussed in greater detail below, the head 536 of each lift rod 530 is removably attached to the extractor ring 222 (see FIGS. 9A-9C). As shown in FIG. 5A, the lift rod 530 and the spring 532 are received in an aperture 370 (see FIG. 3A) in the reservoir tank 212. The spring 532 acts between the reservoir tank 212 and the lift rod 530 to bias the extractor ring 222 downward, or against the floor or carpet. As shown in FIG. 10A, the two corrugated hoses 288 connecting the extractor ring 222 to the recovery tank 214 also help keep the extractor ring in contact with the cleaning surface. Similarly, as shown in FIG. 11A, the extractor ring 1122 includes two corrugated hoses 1188 connecting the extractor ring to a recovery tank and may bias the extractor ring downward, or against the floor or carpet.

Generally, the extractor may be removed from the cleaning device. A removable extractor provides for easier clean out of the extractor. In some embodiments, the hose connecting the extractor to the recovery tank may be connected to a sink or garden hose to clean out the extractor. For example, as shown generally in FIGS. 9A-9C, the heads 536 of the lift rods 530 of the cleaning device 200 may be removably attached to lift rod attachment assemblies 944 mounted on the extractor ring 222. As shown in FIG. 9B, the spring loaded clasp 946 of each lift rod attachment assembly 944 locks the head 536 of the lift rod 530 to the extractor ring 222, allowing the extractor ring to move with the lift rod. The spring loaded clasp 946 is slidably connected to the extractor ring 222 and has a slot 948. The slot 948 engages the neck 950 of the head 536 to lock the extractor ring 222 to the lift rod 530. Removal of the extractor ring 222 requires pulling the two spring loaded clasps 946 on either side of the extractor ring 222 and removing the heads 536 of the lift rods 530. In addition, as shown in FIG. 9A, the two corrugated hoses 288 connecting the extractor ring 222 to the recovery tank 214 must be disconnected. The connection 234, 236, or fitting, connecting the hoses 288 to the recovery tank 214 may be any suitable connection, such as a garden hose type connection or a quick disconnect. The corrugated hoses 288 may then be connected to a sink or garden hose to clean out the assembly. Similarly, as shown generally in FIGS. 11A-11B, lift rods of a cleaning device may be removably attached to lift rod attachment assemblies 1144 mounted on the extractor ring 1122. Removal of the extractor ring 1122 would require pulling two spring loaded clasps 1134 on either side of the extractor ring 1122 and removing heads of the lift rods. In addition, as shown in FIG. 11A, the two corrugated hoses 1188 connecting the extractor ring 1122 to a recovery tank must be disconnected.

In some embodiments, the extractor may also be locked at various positions relative to the reservoir. For example, as shown in FIG. 5C, the lift rods 530 of the cleaning device 200, which are removably attached to the extractor ring 222, may be locked into various positions with the spring loaded clasp 534. As shown in FIG. 5A, the spring loaded clasp 534 is slidably connected to the reservoir tank 212 and has a slot 538 (shown in FIG. 5C). The slot 538 engages portions of the lift rods 530 with reduced diameters, such as 530*a* and 530*b* in FIG. 5A, to lock the lift rod 530 in place. As shown in FIG. 5A, notches 256 defined in the reservoir tank 212 allow access to each spring loaded clasp 534 connected to the reservoir tank.

The extractor may also be interchangeable with other types of extractors. For example, extractors may be designed for use on different types of surfaces, such as suctioning excess fluid from carpets or hard floors. A user may want to change extractors on the cleaning device from one surface to another. Extractors may also come in different sizes and shapes, with various types of holes or slots for suctioning up used cleaning fluid.

In some embodiments, the extractor may have a removable attachment for using the cleaning device of various surfaces. For example, as shown generally in FIGS. 10A, 12A-12C, the extractor ring 222 of the cleaning device 200 has a squeegee 219 for use on hard floors. The depicted squeegee 219 is made of urethane and attached by at least one fastener to the bottom side of the extractor ring 222. The squeegee 219 may, however, be made from any suitable material known in the art. The squeegee 219 may also be attached to the underside of the extractor ring 222 by any suitable means, such as with a screw, bolt, or adhesive.

Figure 12A:
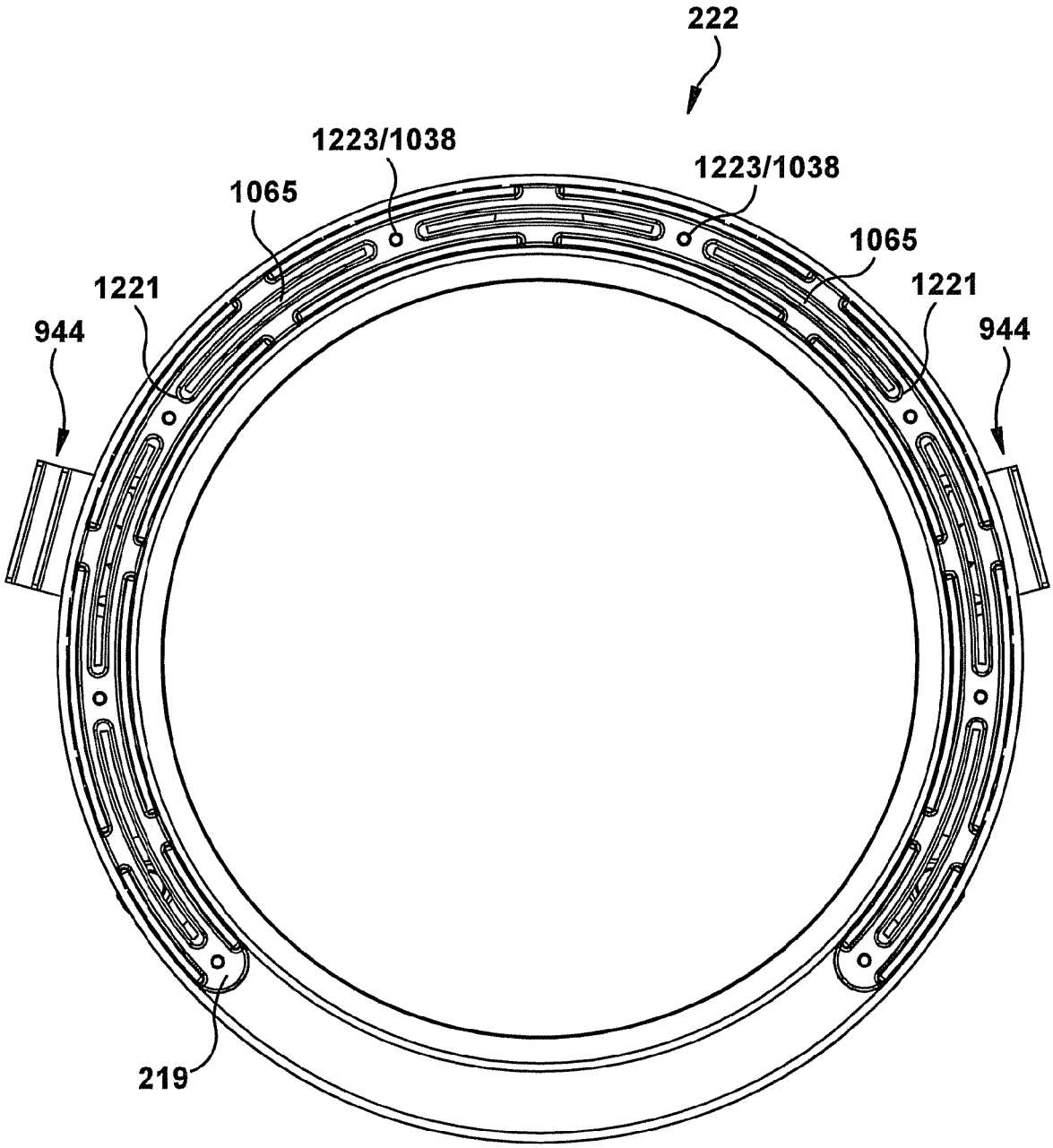
FIG. 12A is a bottom view of the extractor ring shown in FIGS. 10A-10D, wherein a squeegee is attached to the bottom of the extractor ring.
Figure 12B:
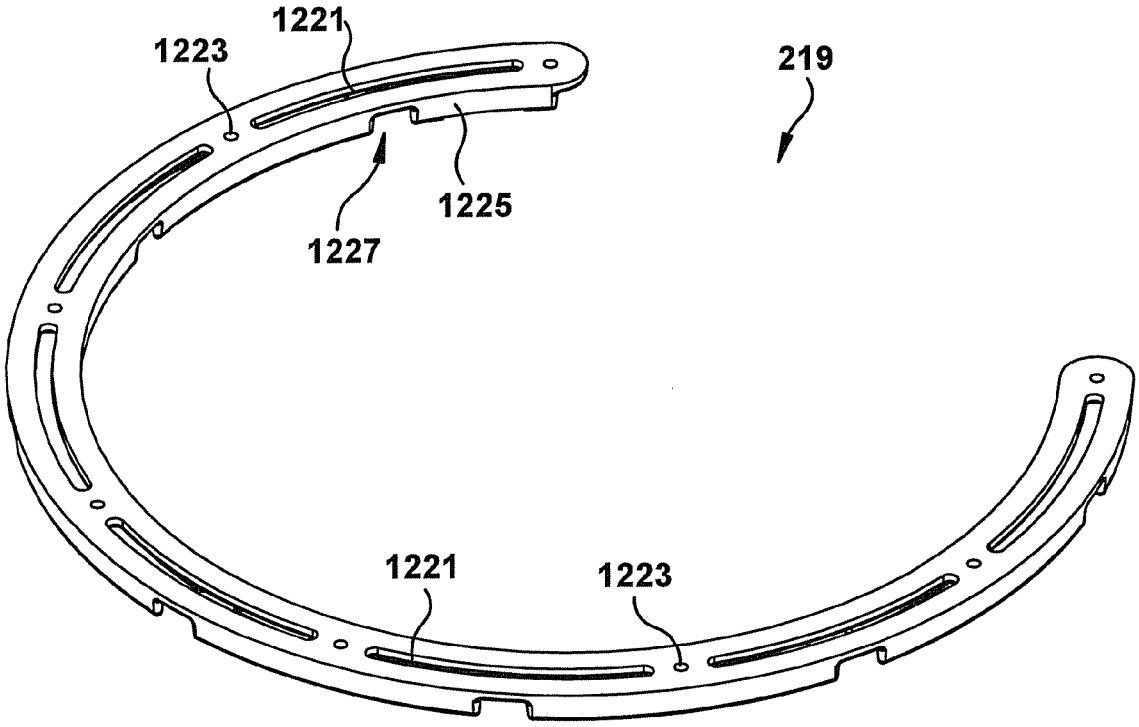
FIGS. 12B-12C are top and bottom perspective views, respectively, of the squeegee shown in FIG. 12A.
Figure 12C:
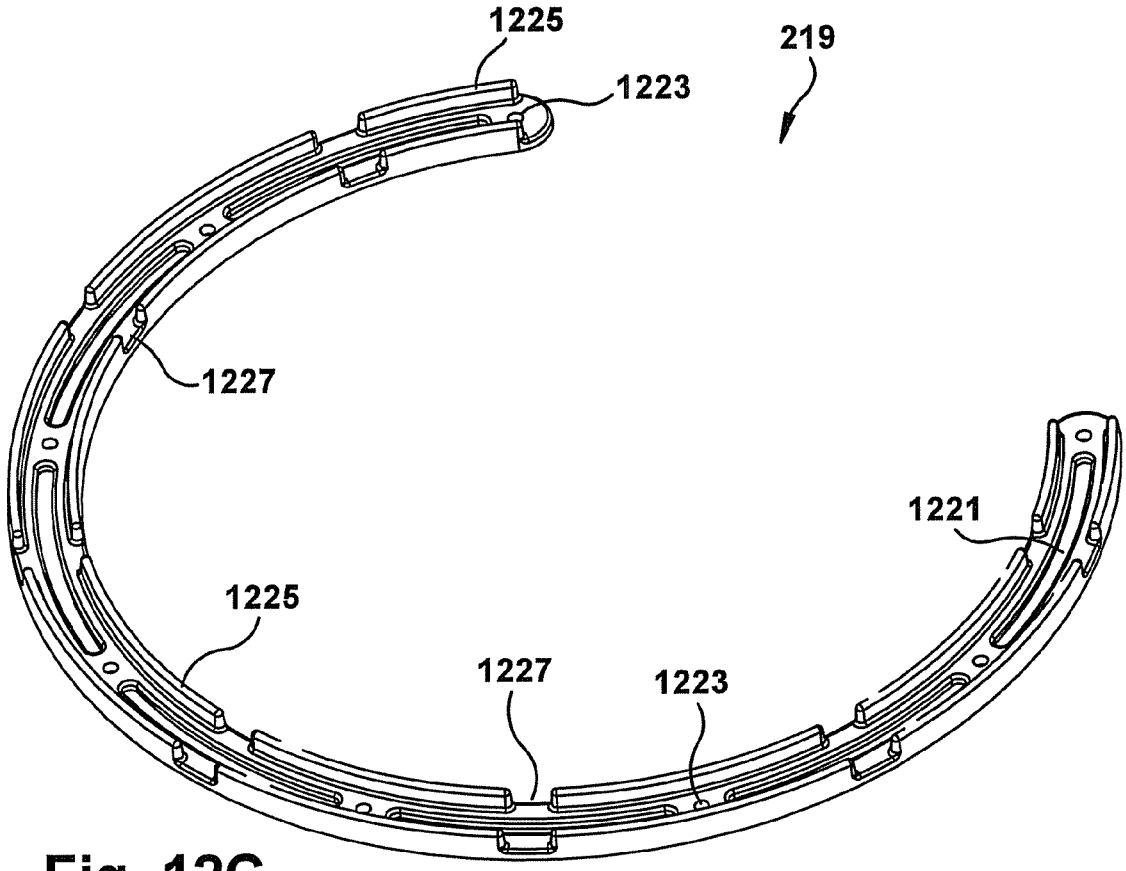

As shown in FIGS. 12A-12C, the squeegee 219 is partially circular in shape and has slots 1221 and holes 1223 that substantially align with the slots 1065 and holes 1038 in the bottom of the extractor ring 222. In other embodiments, however, the squeegee is fully circular in shape. Further, the squeegee 219 has walls 1225, or sides, and channels 1227 that allow the used fluid to be pushed along the hard floor by the walls and guided into the channels such that the fluid may be suctioned through the slots 1065 in the bottom of the extractor ring 222. However, the walls 1225, slots 1221, holes 1223, and/or channels 1227 of the squeegee 219 may include various configurations suitable for guiding used fluid from a hard floor through the slots 1065 in the bottom of the extractor ring 222.

The squeegee 219 may also be removed from the extractor ring 222. For example, as shown in FIGS. 12B-12C, the squeegee 219 has been removed from the extractor ring 222. Without the squeegee, the extractor ring 222 is designed for suctioning excess fluid from carpet through the slots 1065 located on the underside of that extractor ring 222.

A handle is generally attached to the base of the cleaning device. The handle allows the user to control the cleaning device. The handle may also be pivoted and/or extended such that the handle may be adjusted for various users. For example, as shown in FIG. 5A, a handle mounting bracket 512 is attached to a handle mounting portion 372 of the reservoir tank 212, which acts as the base of the cleaning device 200. The handle 218 is pivotally attached to the handle mounting bracket 512. As shown in FIG. 5B, teeth 540 located on the mounting bracket 512 allow the handle 218 to lock at various angles. Other embodiments of the mounting bracket 512 may have more or less teeth. As shown in FIG. 2D, a plate 270 attached to the handle 218 releasably engages the teeth 540 to lock the handle in place. The plate 270 may be various shapes capable of releasably engaging the teeth 540 of the mounting bracket 512.

Figure 15A:
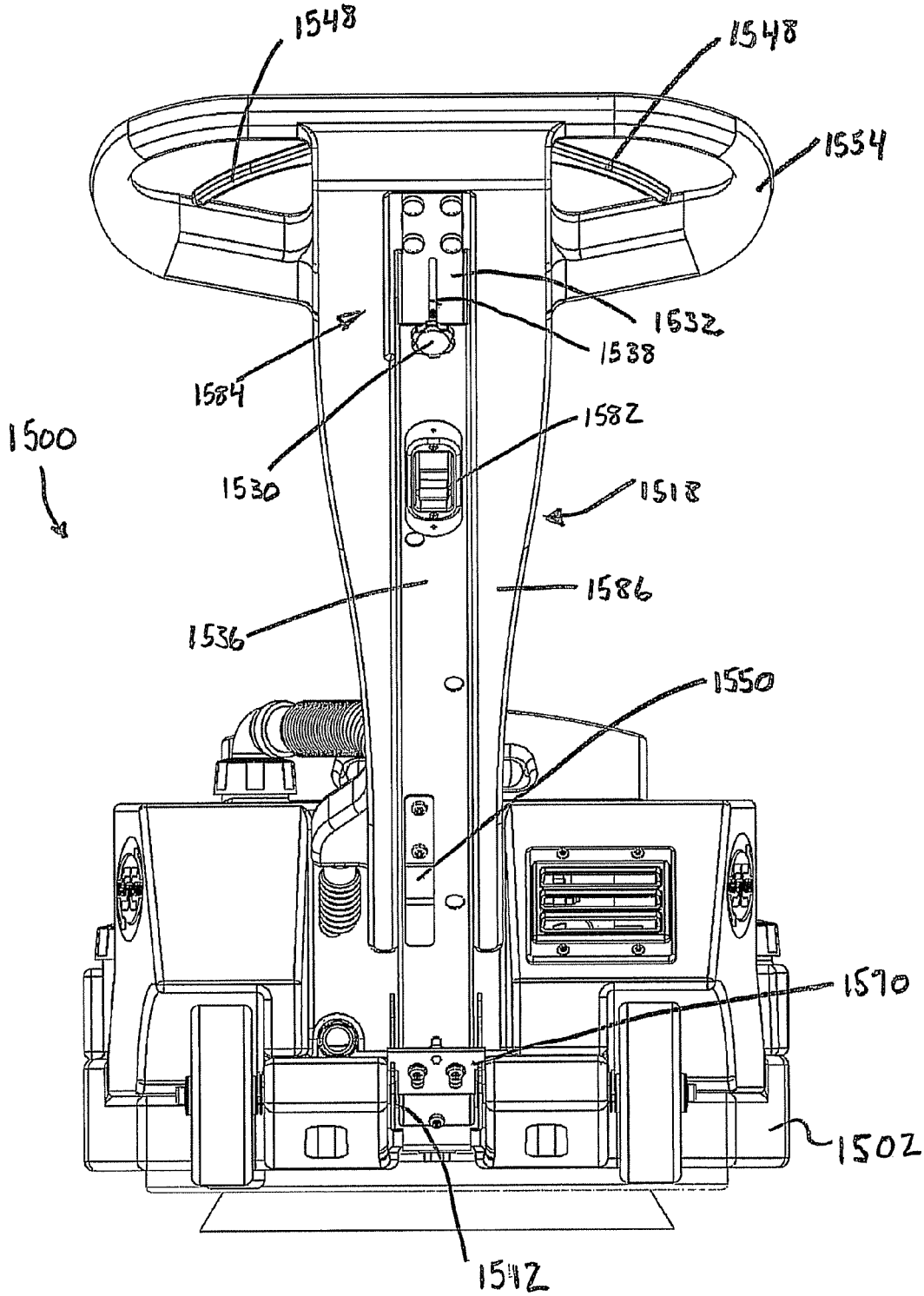
FIG. 15A is a rear view of an assembled cleaning device according to another embodiment of the invention.
Figure 15B:
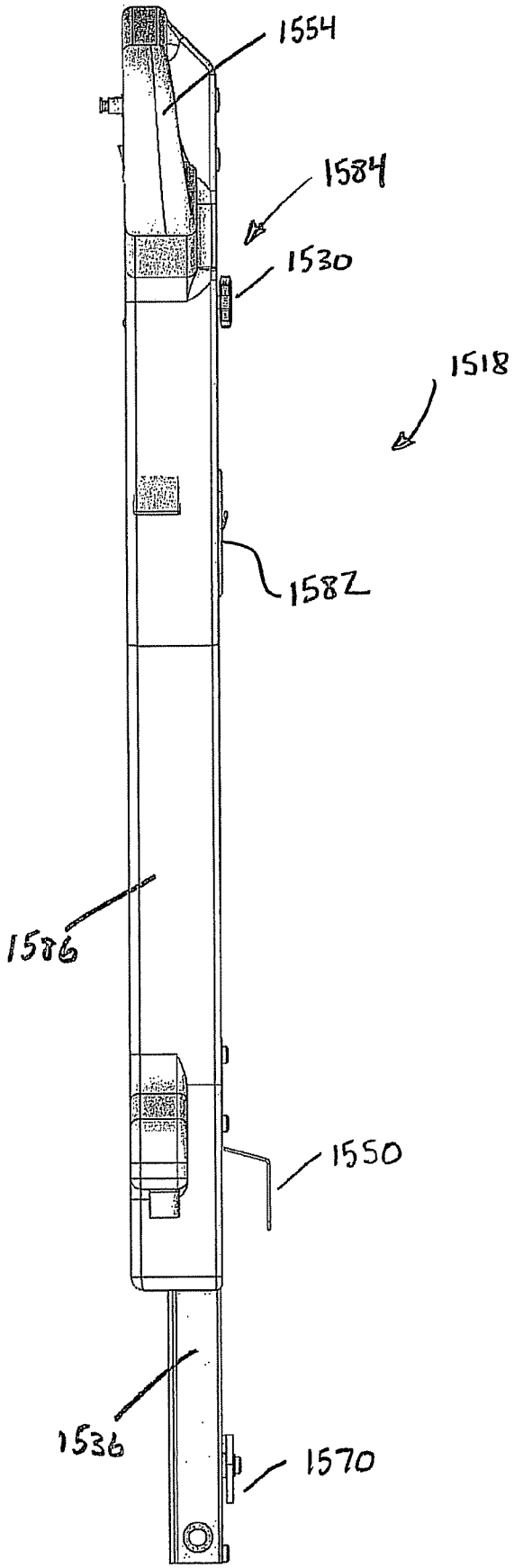
FIGS. 15B-15C are left side and rear views, respectively, of a handle of the cleaning device shown in FIG. 15A.
Figure 15C:
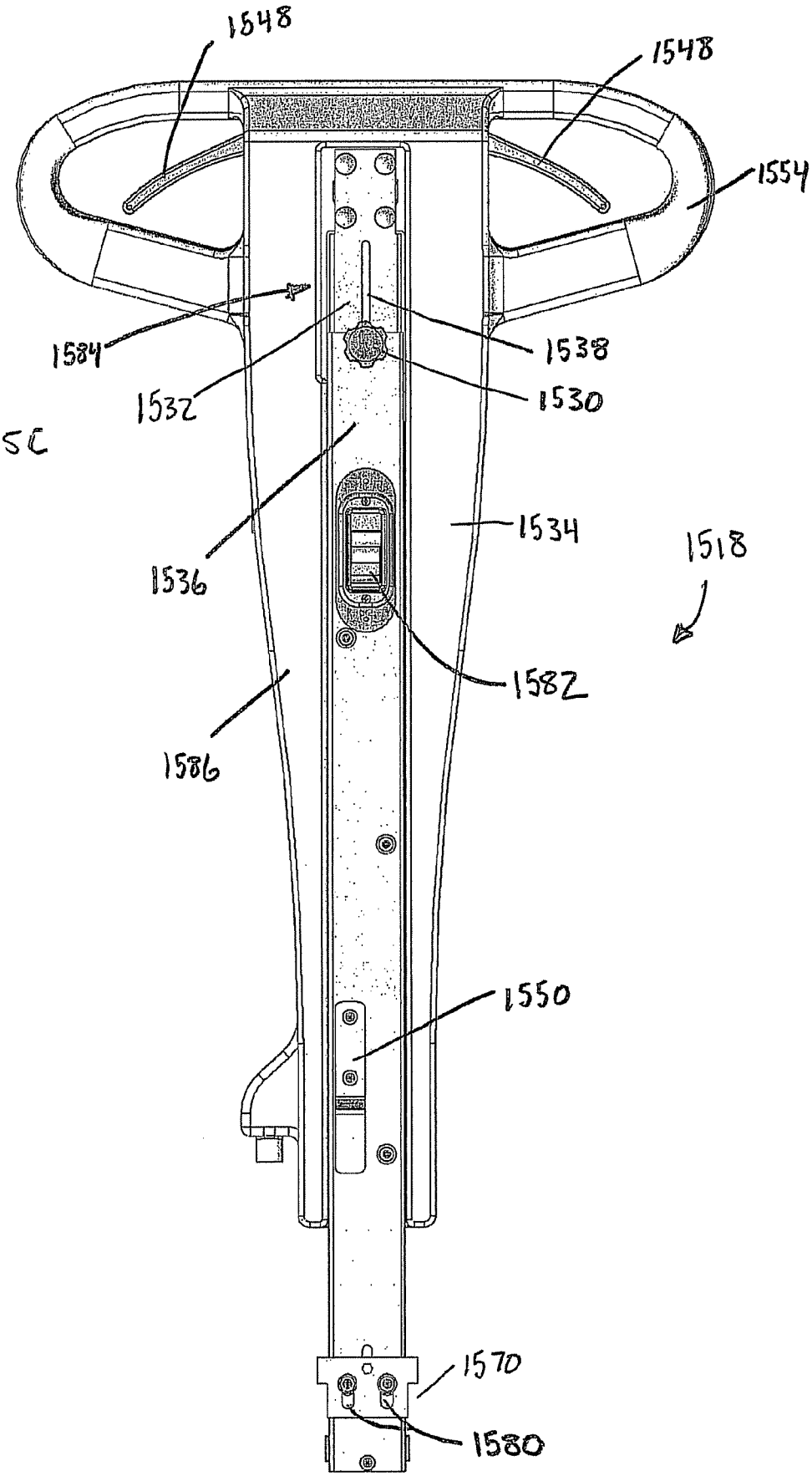

A handle 1518 of a cleaning device 1500 according to another embodiment of the invention is shown in FIGS. 15A-15C. Cleaning device 1500 includes a handle mounting bracket 1512 attached to a reservoir tank 1502, which also acts as the base of the device. The handle 1518 is pivotally attached to the handle mounting bracket 1512 and teeth located on the mounting bracket allow a plate 1570 attached to the handle to lock the handle at various angles.

As shown in FIG. 15C, slots 1580 in the plate 1570 allow the plate to move relative to a frame portion 1536 of the handle 1518. An actuator 1582, such as a spring loaded lever, is attached to the plate 1570, such as with a cable or rod, to move the plate relative to the frame portion 1536. As the user of the device 1500 rotates the actuator 1582, for example downward or towards the cleaning surface, the plate 1570 rides upward and disengages from the teeth of the mounting bracket 1512. With the plate 1570 disengaged from the teeth of the mounting bracket 1512, the user is able rotate the handle 1518 and position the handle at various angles. Upon release of the actuator 1582, a spring (not shown) biases the plate 1570 downward such that the plate engages the teeth of the mounting bracket 1512 and locks the handle 1518 in position.

Further, the handle 1518 of cleaning device 1500 may be adjustably extended with a slide adjustment assembly 1584. The slide adjustment assembly 1584 allows an outer portion 1586 of the handle 1518 to slidably adjust relative to the frame portion 1536. The slide adjustment assembly 1584 includes a plate 1532 having an elongated slot 1538 attached to the outer portion 1586 and an adjustment knob 1530, or fastener, removably connected to the frame portion 1536. The adjustment knob 1530 is disposed within the slot 1538 of the plate 1532 and may be tightened to lock the outer portion 1586 relative to the frame portion 1536 of the handle 1518. The user of the device 1500 can adjust the length of the handle 1518 by loosening the adjustment knob 1530 and sliding the outer portion 1586 relative to the frame portion 1536. The handle 1518 of the device 1500 may be positioned to accommodate various sizes of users by adjusting the angle and the length, as described above.

Figure 13A:
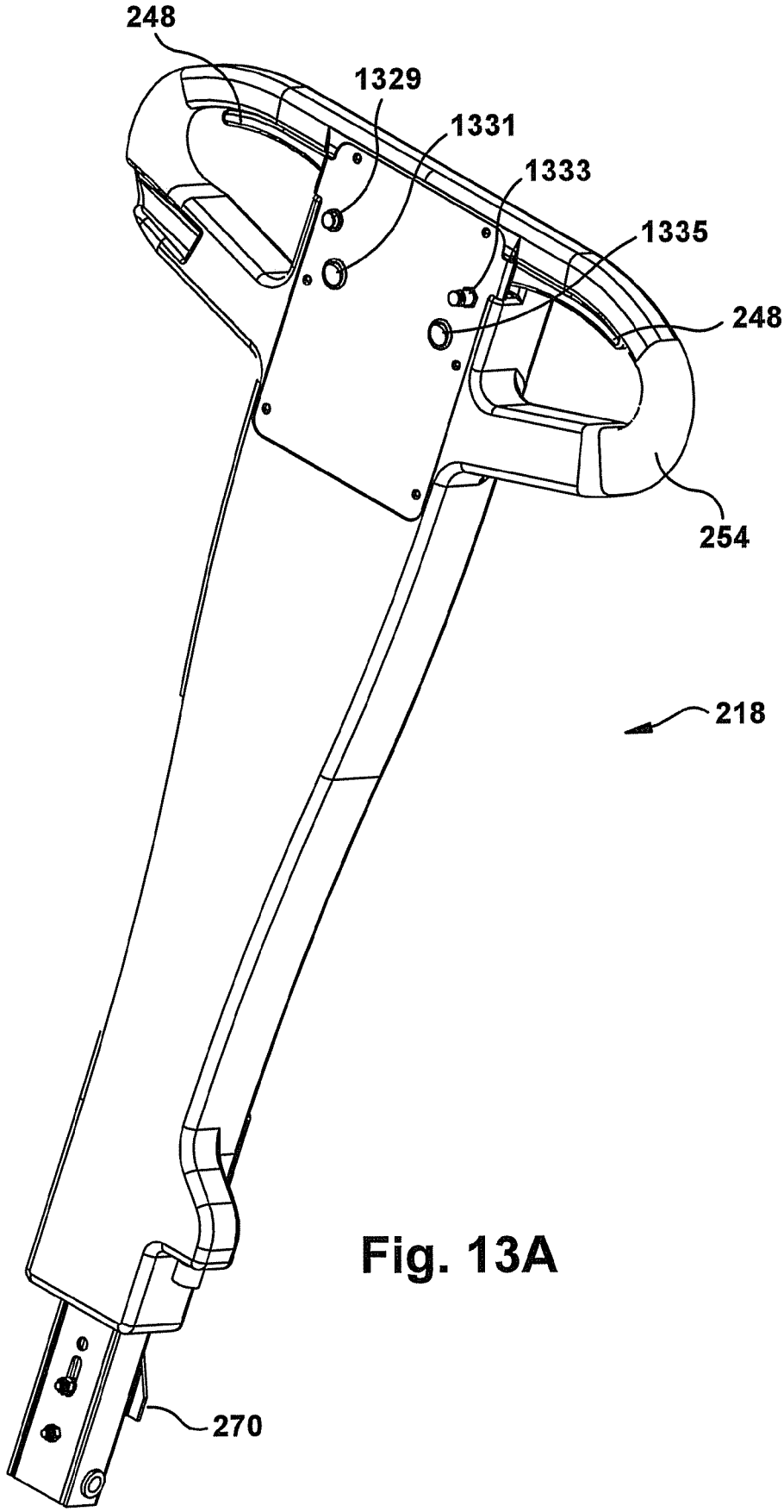
FIGS. 13A-13C are perspective, left side, and rear views, respectively, of a handle of the cleaning device shown in FIGS. 2A-2G.
Figure 13B:
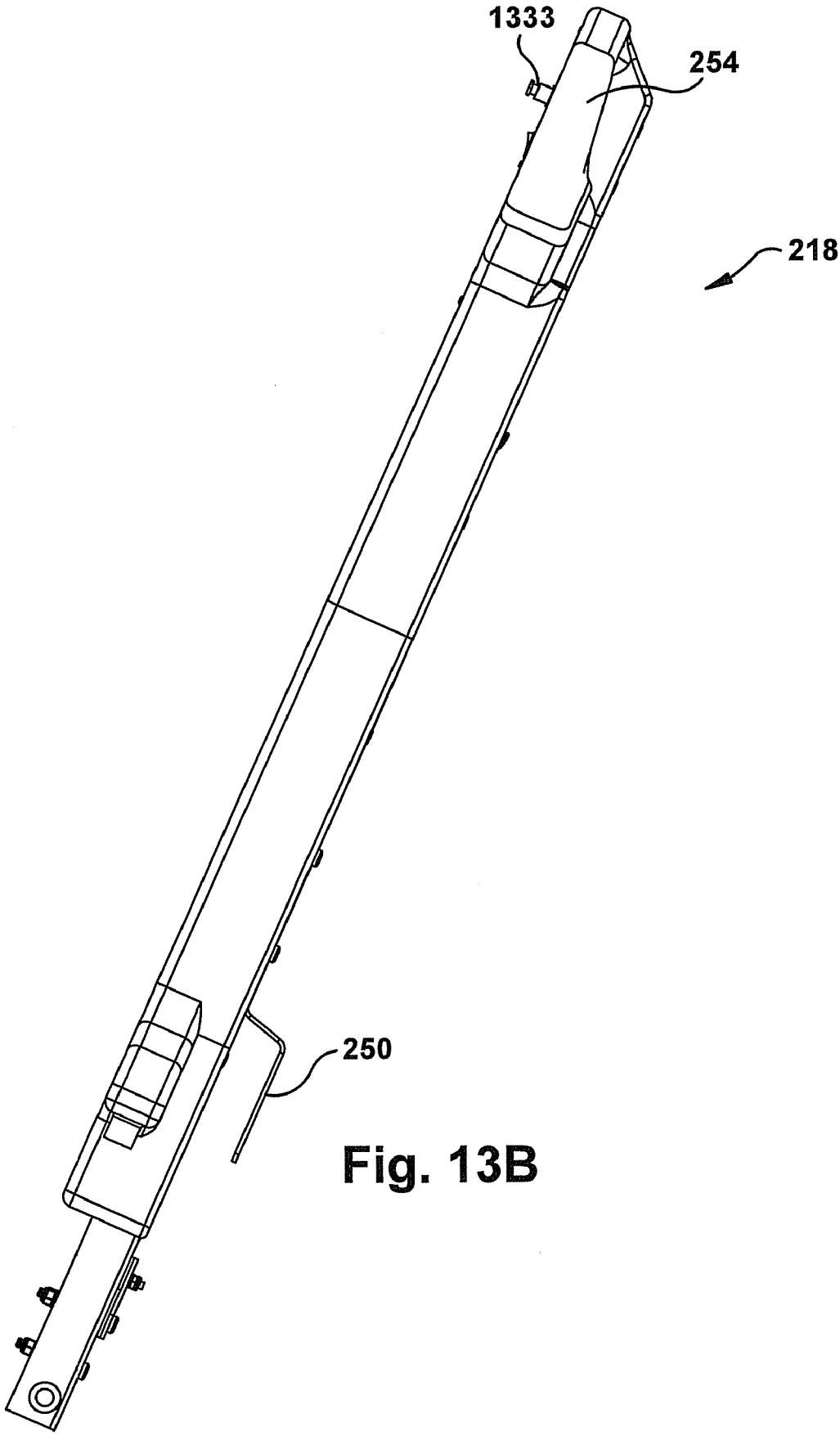
Figure 13C:
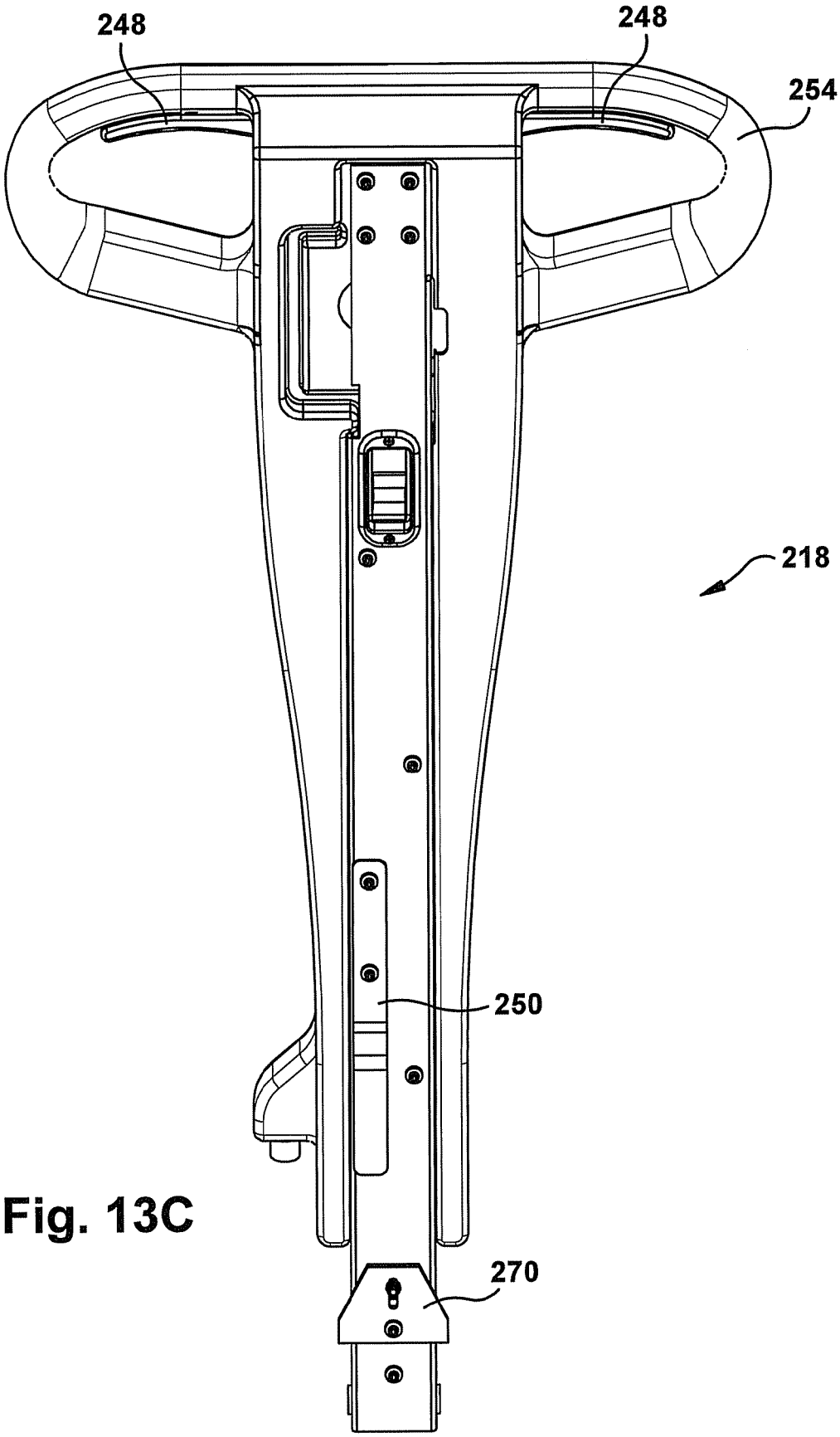

In some embodiments, the handle of the cleaning device has a guard that protects the user's hands and prevents marking the wall during operation of the device. Further, the handle may have controls for operating the cleaning device and a bracket for storing the power cord. For example, as shown in FIG. 2A, the handle 218 of the cleaning device 200 has a guard 254 to protect the user's hands. Further, the handle 218 has levers 248 for operating the brush motor 510. As shown in FIG. 13A, the handle 218 also has switches that operate the vacuum motor (switch 1331), pump (switch 1333), and valves (switch 1335). Finally, as shown in FIG. 2D, the rear of the handle 218 has a bracket 250 for storing the power cord. Similarly, as shown in FIG. 15A-15C, the handle 1518 of cleaning device 1500 has a guard 1554, levers 1548, and switches that operate the vacuum motor, pump, and valves. As shown in FIG. 15A, the rear of the handle 1518 has a bracket 1550 for storing the power cord.

An axle and wheels of the cleaning device are generally rotatably attached to the base of the cleaning device. The cleaning device may have more than one axle and the wheels may be any suitable wheels known in the art. For example, as shown in FIG. 6B, an axle 698 with two wheels 220 is rotatably attached to the reservoir tank 212 of the cleaning device 200. The axle 698 extends between two wheel mounting portions 262 of the reservoir tank 212, wherein each wheel mounting portion has at least one aperture with a bushing. Each wheel 220 is removably attached to either end of the axle 698. The depicted wheels 220 are 6"×2" lightweight polypropylene wheels.

Various mechanical and electrical components of the cleaning device, such as the vacuum device, pump, valves, and terminal block, are attached to the base. These mechanical and electrical components are generally protected by some type of cover. For example, as shown in FIG. 6A, a vertical mounting plate 618 is attached to plate mounting portions 376 (see FIG. 3B) of the reservoir tank 212, which acts as the base of the cleaning device 200. As shown in FIG. 6B, the vertical mounting plate 618 supports various components, including the vacuum motor 626, a pump 620, valves 622, 624, and a terminal block 660. Further, equipment shroud mounting brackets 542 are attached to shroud mounting portions 374 (see FIG. 3B) of the reservoir tank 212. As shown in FIG. 2A, the shroud mounting brackets 542 hold the equipment shroud 216 in place. Similarly, as shown in FIG. 4A, reservoir tank 412 includes plate mounting portions 476, shroud mounting portions 474, handle mounting portion 472, and wheel mounting portions 462.

As shown schematically in FIG. 1, to dispense the cleaning fluid of the cleaning device 100 onto the cleaning surface, the user may first operate the pump 117. The pump 117 of the cleaning device 100 operates to pump the cleaning fluid from the reservoir 111 for application to the cleaning surface. Any suitable pump may be used, such as a 12 VDC pump. The pump may be operated using a control 131, such as a momentary pushbutton switch, of the cleaning device 100. For example, as shown in FIG. 6B, the pump 620 of the cleaning device 200 operates to pump the cleaning fluid from the reservoir tank 212 for application to the cleaning surface. The depicted pump 620 is a SHURflo® SLV Series 12 VDC pump. The pump 620 is operated by activating a switch 1333 (shown in FIG. 13A) located on the handle 218.

Also shown schematically in FIG. 1, a filter 181 may be inserted between the reservoir tank 111 and the pump 117 to filter particulates and/or contaminates from the cleaning fluid. Any filter capable of removing particulates and/or contaminates from the cleaning fluid may be used. For example, an inline hose strainer with a domed wire screen filter inside a removable cartridge may be used. The removable cartridge allows access to replace and/or clean the filter. The reservoir 111 may also have fluid height detectors 155. In certain embodiments, the reservoir 111 has electrical sensors or switches attached to the reservoir that detect the amount of cleaning fluid in the reservoir. In other embodiments, marks on the reservoir 111 indicate the height and/or amount of fluid remaining in the reservoir.

The pump 117 shown schematically in FIG. 1 delivers the cleaning fluid from the reservoir 111 to a valve assembly 119. The user may control the valve assembly 119 to direct the cleaning fluid to the cleaning surface in various ways. For example, the cleaning fluid may be dispensed through dispensers 121, such as nozzles, located on the cleaning device 100. Further, the cleaning fluid may be dispensed directly to the cleaning tool 107 (as shown by arrow 177 in FIG. 1). The cleaning fluid may be dispensed through the dispensers 121 and directly onto the cleaning tool 107 simultaneously.

The valve assembly 119 shown schematically in FIG. 1 may include any suitable valve(s), such as two normally closed valves. In certain embodiments, the pump 117 controls the dispensing of the cleaning fluid. Also, timers may be added to control the dispensing of the fluid at certain intervals. The valve assembly 119 may be operated by a control 129, such as an illuminated rocker switch, of the cleaning device 100. By operating the valve assembly 119, the user may dispense the cleaning fluid to the cleaning surface through the dispensers 121 or onto the cleaning tool 107 directly, or both.

For example, as shown in FIGS. 6A-6B, the pump 620 of the cleaning device 200 transfers the cleaning fluid from the reservoir tank 212 through a hose 605 to the pump. The fluid is then transferred through hoses 637, 639 to valves 622, 624, respectively, mounted on the vertical mounting plate 618. These valves 622, 624 direct the cleaning fluid such that it may be dispensed to the cleaning surface through the nozzles 215 (see FIG. 2A) mounted on the nozzle block 246 located on the front of the cleaning device 200 or onto the brush 224 bristles directly, or both (ex., if both valves are open). The valves 622, 624 may be any suitable valve, such as ASCO® normally closed valves.

Figure 14:
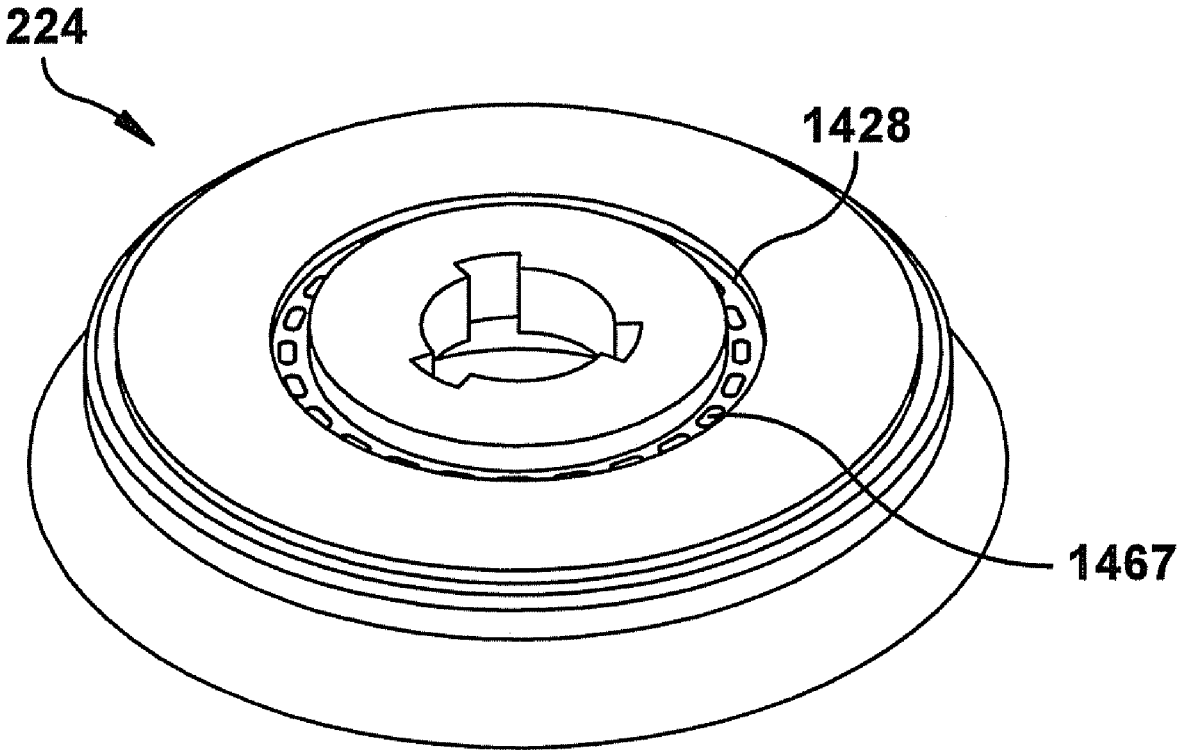
FIG. 14 is a perspective view of a brush of the cleaning device shown in FIGS. 2A-2G.

The valves 622, 624 of the cleaning device 200 are operated by activating a switch 1335 (shown in FIG. 13A), such as an illuminated rocker switch, located on the handle 218. By operating the switch, the user may dispense the cleaning fluid to the cleaning surface through spray nozzles 215 mounted on the nozzle block 246 located on the front of the cleaning device 200 or onto the brush 224 bristles directly, or both. To apply cleaning fluid from the reservoir tank 212 to the brush 224 bristles, the fluid travels from the valve 622 (shown in FIG. 6B), through an aperture 326 (shown in FIG. 3A) in the reservoir tank 212, and collects in a trough 1428 (shown in FIG. 14) located on the top of the brush 224. As shown in FIG. 14, holes or slots 1467 in the trough 1428 allow the fluid to drip down over the bristles of the brush 224.

As shown in FIG. 7E, the nozzle block 246 of the cleaning device 200 has antenna type spray nozzles 215 extending from openings on the top of the block for dispensing cleaning fluid from the reservoir tank 212 to the cleaning surface. As shown in FIGS. 7F-7G, the nozzle block 246 also has an opening with a connection 584 in the rear of block for receiving the hose carrying cleaning fluid from the reservoir tank 212. As discussed above, the nozzle block 246 is connected to a valve 624 mounted on the vertical mounting plate 618 and operated by a switch located on the handle 218.

Generally, the user must operate the motor to activate the cleaning tool. The cleaning tool may move in various ways, such as rotating, vibrating, or in a back and forth motion. The cleaning tool utilizes the cleaning fluid dispensed from the reservoir to scrub and/or polish the cleaning surface. The cleaning tool may be various types of tools known in the art, such as a soft cloth or scrubbing brush. The motor may be a 1 hp motor; however, other suitable motors may be used, for example a ½ hp or 2 hp motor. As shown schematically in FIG. 1, the motor 109 may be operated by controls 125, 127, such as levers, switches, or pushbuttons, of cleaning device 100. For example, a lever may control the speed of the motor while a pushbutton or switch controls the power to the motor.

As shown in FIG. 5A, the brush 224 (shown in FIG. 14) of the cleaning device 200 is rotated by the brush motor 510 mounted to the reservoir tank 212. As shown in FIG. 2A, the brush motor 510 may be operated by levers 248 attached to the handle 218 of the cleaning device 200. The levers 248 allow the user to control the speed of the brush motor 510. The depicted brush motor 510 is a 120/240 volt AC, 1 hp brush motor producing a brush speed of approximately 175 RPM. The depicted cleaning brush 224 is a 16" diameter scrubbing brush. The cleaning device may include a gear case, such as a 10:22 planet gear box. As shown in FIG. 3A, the reservoir tank 212 has apertures 366 with bushings for mounting the brush motor 510. Further, the reservoir tank 212 has a larger aperture 368 to allow the shaft of the brush motor 510 to attach to the brush 224. The weight of the brush motor 510 directly over the brush 224 allows the cleaning device 200 to be more balanced and easier to control. Similarly, as shown in FIG. 4A, reservoir tank 412 includes apertures 466 for mounting a brush motor and a larger aperture 468 to allow the shaft of the brush motor to attach to a brush.

The weight of the reservoir, recovery tank, extractor, and motor of the cleaning device may, in some embodiments, be distributed over the cleaning tool. With the weight of these components over the cleaning tool, the cleaning device is balanced and easily controlled. For example, as shown generally in FIGS. 2A, 2G, and 5A, the weight of the reservoir 212, recovery tank 214, extractor 222, and motor 510 are distributed over the cleaning tool 224 of the cleaning device 200.

As shown schematically in FIG. 1, the used fluid is suctioned from the cleaning surface through the extractor 105 and into the recovery tank 113 by a vacuum device 115. The vacuum device 115 may be any suitable vacuum device, such as a vacuum motor and/or vacuum pump. The user may operate the vacuum device 115 by using the control 133, such as a switch, lever, or button, of the cleaning device 100.

The vacuum device 115 shown schematically in FIG. 1 is connected to the recovery tank 113 by a tube 159, such as a corrugated tube. The vacuum device 115 creates a vacuum that allows the extractor 105 to suction any used fluid through the extractor 105 and the hose 145, and into the recovery tank 113. The used fluid collects in the recovery tank 113 until the tank 113 is emptied. The tube 159 may have holes or slots towards the end of the tube 159 located inside the recovery tank 113. These holes or slots help prevent the used fluid inside the recovery tank 113 from being pulled through the tube 159.

As shown schematically in FIG. 1, the tube 159 and/or recovery tank 113 may also have a shut off valve 161 activated by a float ball or sensor, that would turn off the vacuum device 115 should the recovery tank 113 overfill. The shut off valve 161 protects the vacuum device 115 and the surrounding environment from exhaust 151 spray effects found with conventional vacuum tanks. The exhaust 151 from the vacuum device 115 may be directed out of the cleaning device 100. In certain embodiments, the exhaust 151 may pass through a replaceable filter, such as a HEPA filter.

For example, as shown in FIG. 6B, to operate the vacuum system of the cleaning device 200, the user must operate the vacuum motor 626 mounted on the vertical mounting plate 618 and connected to the recovery tank 214 by the corrugated tube 209. The vacuum motor 626 creates a vacuum that allows the extractor ring 222 to suction any used fluid into the recovery tank 214. The vacuum motor 626 may be any suitable vacuum motor know in the art, such as an AMETEK Lamb vacuum motor. As shown, the vacuum motor 626 produces approximately 79 inches of water lift and approximately 97 cubic feet per minute (CFM) of air volume.

The corrugated tube 209 extends from an end 628 of the vacuum motor 626, through an aperture 230 (shown in FIG. 2A) in the top of the equipment shroud 216, and connects to the rigid tube 647. The rigid tube 647 extends into the recovery tank 214 through opening 232 (shown in FIG. 2E), which has modified cap 211 that allows the tube 647 to extend into the recovery tank. The used fluid is suctioned through slots 1065 (shown in FIG. 10C) in the bottom of the extractor ring 222, through the two corrugated hoses 288 (shown in FIG. 2B), and accumulates in the bottom of the recovery tank 214.

As shown in FIG. 6A, the rigid tube 647 has at least one slot 645 towards the end of the tube 647 located inside the recovery tank 214. This slot 645 helps prevent the used fluid inside the recovery tank 214 from being pulled through the tube 647. The tube 647 also has a shut off valve activated by a float ball 643 that turns off the vacuum motor 626 should the recovery tank 214 overfill. The shut off valve protects the vacuum motor 626 and the surrounding environment from exhaust spray effects.

As shown in FIG. 6B, the exhaust from the exhaust opening 630 of the vacuum motor 626 of the cleaning device 200 is directed through louvered vents 238 (see FIG. 2D) on the rear of the equipment shroud 216. In the depicted embodiment, the exhaust passes through a replaceable filter, such as a HEPA filter, before exiting through the louvered vents 238.

While several embodiments of the invention have been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses.

What is claimed is:

1. A cleaning device suitable for cleaning surfaces, comprising:

a cleaning tool;

a motor that activates the cleaning tool;

a reservoir for storing fluid that is at least a portion of the base of the cleaning device, wherein at least a portion of the reservoir comprises at least a portion of the bottom surface of the base;

an extractor for suctioning used fluid from the surface which is movably attached to the reservoir such that the extractor can be raised and lowered relative to the surface; and a recovery tank for storing the used fluid from the extractor, wherein the recovery tank is at least partially supported by a portion of the reservoir.

2. The cleaning device of claim 1, wherein the cleaning device is designed such that at least a portion of the weight of the fluid in the reservoir and the used fluid in the recovery tank is over the cleaning tool.

3. The cleaning device of claim 1, wherein the overall height of the cleaning device is equal to or less than 24 inches.

4. The cleaning device of claim 1, wherein the reservoir further comprises formed shapes that help prevent movement of the fluid inside the reservoir.

5. The cleaning device of claim 1, wherein the motor is attached to the reservoir.

6. The cleaning device of claim 1, wherein the extractor is biased against the surface to help suction used fluid from the surface.

7. The cleaning device of claim 1, wherein the extractor is circular in shape.

8. The cleaning device of claim 1, wherein the extractor further comprises a squeegee for cleaning hard surfaces.

9. The cleaning device of claim 1, wherein the extractor further comprises corrugated hoses and connections that may be connected to at least one of a sink and a garden hose for clean out.

10. The cleaning device of claim 1, wherein the recovery tank is removable to provide for easier clean out of the recovery tank.

11. The cleaning device of claim 1, wherein a pump and at least one valve control dispensing of fluid onto the cleaning surface and the cleaning tool.

12. The cleaning device of claim 1, wherein a vacuum device connected to the recovery tank pulls the used fluid from the surface, through at least one slot in the extractor, and into the recovery tank.

13. The cleaning device of claim 12, wherein a tube connecting the vacuum device to the recovery tank has holes towards an end of the tube located inside the recovery tank to help prevent the used fluid inside the recovery tank from being pulled through the tube.

14. The cleaning device of claim 12, wherein the recovery tank has a shut off valve activated by a float ball that turns off the vacuum device should the recovery tank overfill.

15. The cleaning device of claim 12, wherein exhaust from the vacuum device passes through a filter.

16. The cleaning device of claim 1, wherein a handle connected to the cleaning device has a guard to protect a user's hands and fingers.

17. The cleaning device of claim 16, wherein a length of the handle and an angle of the handle relative to the reservoir are independently adjustable.

18. The cleaning device of claim 1, wherein the extractor is removably attached to at least one lift rod.

19. A cleaning device suitable for cleaning surfaces, comprising:

a cleaning tool;

a motor that activates the cleaning tool;

a reservoir for storing fluid that is at least a portion of the base of the cleaning device, wherein at least a portion of the reservoir comprises at least a portion of the bottom surface of the base;

an extractor for suctioning used fluid from the surface, wherein the extractor is removably attached to at least one support member;

a removable recovery tank for storing the used fluid from the extractor, wherein the recovery tank is at least partially supported by a portion of the reservoir.

20. The cleaning device of claim 19, wherein the overall height of the cleaning device is equal to or less than 24 inches.

21. The cleaning device of claim 20, wherein the capacity of the reservoir is about three gallons and the capacity of the recovery tank is about two gallons.

22. The cleaning device of claim 19, wherein the at least one support member is movably attached to the reservoir such that the extractor can be raised and lowered relative to the surface.

23. The cleaning device of claim 19, wherein at least a portion of the weight of the used fluid in the recovery tank is over the cleaning tool.

24. A method of cleaning a surface using a cleaning device, comprising the steps of:

storing fluid in a reservoir that forms a portion of the base of the cleaning device, wherein at least a portion of the reservoir comprises at least a portion of the bottom surface of the base;

dispensing the fluid onto at least one of the surface and a cleaning tool of the cleaning device;

cleaning the surface using the cleaning tool;

suctioning used fluid from the surface and into a removable recovery tank using an extractor that is movably attached to the reservoir such that the extractor can be raised and lowered relative to the surface; and emptying used fluid from the removable recovery tank, wherein the recovery tank is at least partially supported by a portion of the reservoir.

25. The method of claim 24 further comprising the step of removing the recovery tank from the cleaning device.

26. The method of claim 24 further comprising the step of cleaning out the extractor by connecting an end of at least one corrugated hose attached to the extractor to at least one of a sink and a garden hose.

27. A cleaning device suitable for cleaning surfaces, comprising:

a cleaning tool;

a motor that activates the cleaning tool;

a reservoir for storing fluid that is at least a portion of the base of the cleaning device, wherein at least a portion of the reservoir comprises at least a portion of the bottom surface of the base;

an extractor for suctioning used fluid from the surface which is movably attached to the cleaning device such that the extractor can be raised and lowered relative to the surface; and a recovery tank for storing the used fluid from the extractor, wherein the recovery tank is adjacent the reservoir.

* * * * *